US006176178B1

(12) United States Patent
Schor et al.

(10) Patent No.: US 6,176,178 B1
(45) Date of Patent: Jan. 23, 2001

(54) TAMPER-RESISTANT POSTAGE METER

(75) Inventors: Stephan Schor, Münsingen; Stefan Etter, Oberhofen; Beat Stulz, Fribourg; Thomas Nietlispach, Liebefeld; Christian Gillieron, Fraubrunnen; Christian Moy, Grossaffoltern, all of (CH)

(73) Assignee: Ascom Hasler Mailing Systems AG, Bern (CH)

( * ) Notice: Under 35 U.S.C. 154(b), the term of this patent shall be extended for 0 days.

(21) Appl. No.: 08/400,335

(22) Filed: Mar. 7, 1995

(51) Int. Cl.[7] ..... B41L 47/46
(52) U.S. Cl. ..... 101/91
(58) Field of Search ..... 101/91; 235/101, 235/130 R

(56) References Cited

U.S. PATENT DOCUMENTS

| | | | | |
|---|---|---|---|---|
| 4,246,643 | * | 1/1981 | Hubbard | 101/91 |
| 4,271,481 | | 6/1981 | Check et al. | 364/900 |
| 4,283,721 | | 8/1981 | Eckert et al. | 364/680 |
| 4,347,506 | | 8/1982 | Duwel et al. | 340/679 |
| 4,639,581 | | 1/1987 | Berger et al. | 235/101 |
| 4,730,821 | | 3/1988 | Flückiger | 270/58 |
| 4,807,139 | | 2/1989 | Liechti | 364/464 |
| 4,864,505 | * | 9/1989 | Miller et al. | 101/91 |
| 4,887,807 | | 12/1989 | Berger et al. | 271/171 |
| 5,038,153 | | 8/1991 | Liechti et al. | 346/140 |
| 5,060,821 | | 10/1991 | Berger et al. | 221/190 |
| 5,203,263 | | 4/1993 | Berger et al. | 101/76 |
| 5,237,506 | | 8/1993 | Horbal et al. | 364/464 |
| 5,276,844 | | 1/1994 | Aebi et al. | 395/425 |
| 5,278,541 | | 1/1994 | Wicht et al. | 340/636 |
| 5,301,116 | | 4/1994 | Grünig | 364/464 |
| 5,340,965 | | 8/1994 | Horbal et al. | 235/101 |
| 5,359,273 | | 10/1994 | Flückiger | 318/794 |
| 5,363,760 | | 11/1994 | Lindenmueller et al. | 101/91 |
| 5,389,863 | | 2/1995 | Flückiger | 318/549 |
| 5,486,973 | * | 1/1996 | Meur | 361/170 |

FOREIGN PATENT DOCUMENTS

| | | |
|---|---|---|
| 0062376A1 | 10/1982 | (EP) . |
| 0526139A2 | 2/1993 | (EP) . |
| 0526140A2 | 2/1993 | (EP) . |
| WO89/11134 | 11/1989 | (WO) . |

* cited by examiner

*Primary Examiner*—Ren Yan
(74) *Attorney, Agent, or Firm*—James F. McLaughlin; Perman & Green, LLP

(57) ABSTRACT

A postage meter has a locking cam follower so that locking arms on the print wheels of the postage meter are able to lock the wheels from unintended movement when the print rotor is out of its home position. Stiff runners are provided below guide rods of setting racks in the rotor so that the racks cannot be displaced away from the value wheels. A sensor is placed on the rotor cover with the meter software set up to keep a print cycle from starting if the cover is open. A cam on the rotor makes it impossible to open the cover when the rotor is out of the home position. A latch holds the cover shut, and the only way the latch can be released is if the meter software releases it, for example by sliding a rack to a position that triggers the latch. Cogs and cog teeth are used instead of gears and gear teeth to reduce the possibility of unintended movement of the value wheels. Rotating disks lock the racks when the rotor is not in the home position.

9 Claims, 23 Drawing Sheets

FIG. 10.
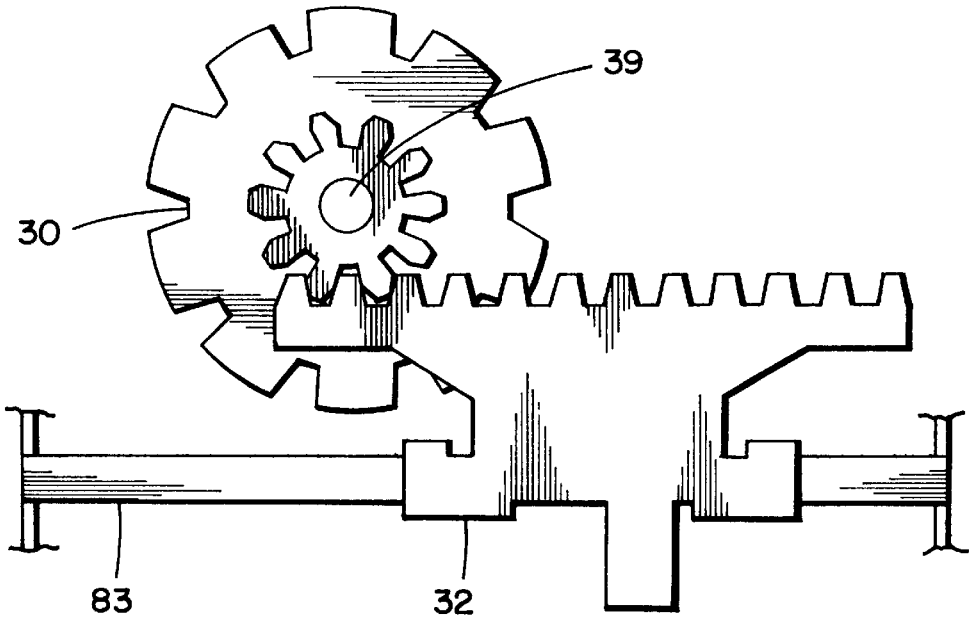
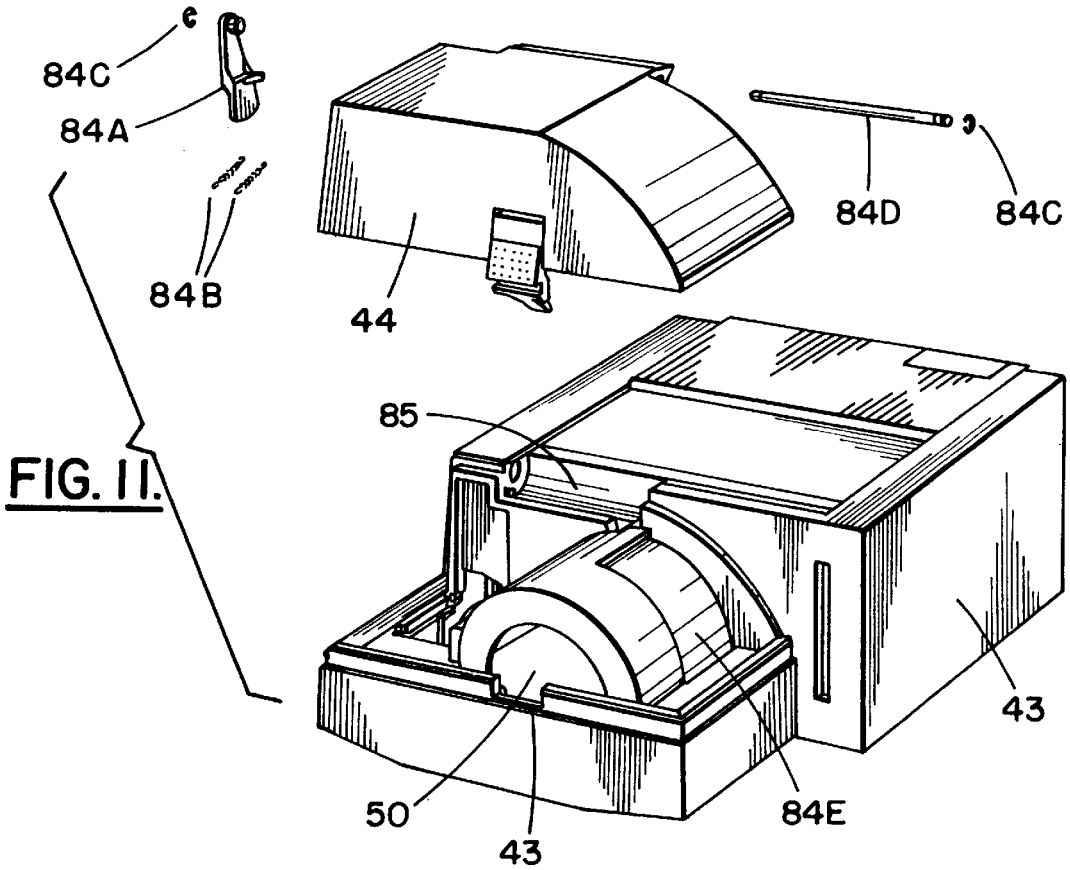
FIG. 11.

130
RECEIVE REQUEST FOR OPENING OF DOOR
131
IS IT PERMITTED NOW ?
NO
132
EXCEPTION HANDLER
YES
133
RELEASE DOOR

135
HAS DATE CHANGED ?
YES
136
RELEASE DOOR, REQUEST THAT USER CHANGE DATE WHEELS
NO

90
REQUEST FOR FRANKING
91
IS COVER OPEN ?
YES
92
EXCEPTION HANDLER
NO
93
PERFORM FRANKING
94
WAS COVER OPENED ?
YES
95
EXCEPTION HANDLER
NO
96
EXIT

TAMPER-RESISTANT POSTAGE METER

The invention relates generally to postage meters, also called franking machines, and relates more particularly to an improved mechanism for setting the value wheels which determine the amount of postage that is printed on a mail piece.

Postage meters are an important part of the postal system. In the United States, for example, about half of all the postage value applied to mail pieces is applied by postage meters rather than by the purchase and application of postage stamps.

Before a model of postage meter is entered into service, it must be tested and certified by the postal authorities. The certification process is directed in part to the ability of the meter to withstand efforts by dishonest parties to print postage without paying for it. Manufacturers of postage meters thus design each model of postage meter to resist such efforts. The meter is, for example, housed in a secure housing.

The majority of postage meter models employ a rotating print head, or rotor, to print postage on mail pieces. The print head contains value wheels, each of which prints one digit of the postage value. Each value wheel is set, prior to the printing of postage, by movement of a mechanical linkage. The linkage must be designed to satisfy many conditions. For example, the linkage must be mechanically reliable, it must set each of (typically five) print wheels to any of ten digit positions, it cannot cost too much money, and perhaps the most daunting condition is that it has to work even though the rotor, and its print wheels, rotate relative to the rest of the postage meter. A typical postal certification test will require that the meter work well during a million print cycles (rotations of the print rotor) and half a million settings (adjustments of the print wheel positions).

The postage meter art is filled with attempts to accomplish the above-mentioned design requirements simultaneously with protecting the meter against misuse by dishonest persons. An extreme example of the latter may be seen in U.S. Pat. No. 4,271,481 to Check et al., in which each print wheel has an integrally mounted transducer that generates a four-wire binary electrical signal communicating the absolute position of the wheel. Five such print wheel/transducer assemblies would not fit within a typical print rotor, of course, and would not be able to be positioned to print five adjacent digits. And it would, of course, be impractical in the extreme to attempt to bring twenty discrete wires out of the rotating rotor to the main body of the postage meter.

The balancing of the numerous requirements on the postage meter most frequently leads to a design in which the rotor itself is purely mechanical. An electromechanical system in main body of the postage meter actuates mechanical linkages to the rotor, and thereby sets the print wheels. The system is under microprocessor control, and feedback sensors permit the microprocessor to achieve a very high degree of confidence that during setting, the electromechanical system of the main body of the meter has moved its linkages to the desired positions. As a consequence, assuming the mechanical linkages to the print wheels are intact, the designer of the meter can have a high degree of confidence that the value wheels are likewise in the desired positions. Stated differently, the confidence that no dishonest person would be able to get postage without paying for it is achieved largely through the use of sophisticated sensors, but for the last few inches of wheel setting mechanism the confidence is achieved by physical robustness thereof.

FIG. 1 shows a typical postage meter 40. A mail piece 41 passes through a slot 42 and receives an imprint of postage from the rotor, not visible in FIG. 1. The rotor is not visible because it is surrounded by a housing or case 43 with a cover 44. Housing 43 is a secure housing as required by postal authorities.

FIG. 2 shows in endwise view a typical print rotor 50 of the postage meter. Disposed around the periphery of the rotor 50 are features which, when brought into contact with the mail piece, print the various parts of the postage indicium. A typical postage indicium, described from right to left as seen on a mail piece, includes a box containing a postage amount, a circle containing the date, and optionally an indication of the mail class and an advertisement. The features of the indicium thus correspond respectively to the part of the rotor containing the value print wheels 30, the date print wheels 51, the mail class print die 52, and the advertising plate 53. Turning again to FIG. 1, it will be appreciated that cover 44 is required to permit user access to date wheels 51 (if manually set), to the mail class die 52, and to the advertising plate 53.

FIG. 3 shows in perspective view rotor 50. In this view it is possible to see part of value wheels 30. Rotor 50 has a long axle or shaft 55 which is held within the main body of the meter when in use. In this view it is also possible to see portions of racks 32, about which more will be said later.

FIG. 4 shows in simplified form a prior-art wheel-setting mechanism for a postage meter. One value wheel 30, also called a print wheel, is shown while the others are omitted for clarity. The print wheel has ten faces 45, one shaped to print each Arabic digit. The wheel 30 turns on an axle 39, and the wheel 30 is stacked with the other print wheels of the rotor. Formed with the wheel is a gear portion 31 having a number of teeth that is a multiple of ten; in the wheel shown the number of teeth is ten. In the figure the topmost face of the wheel is the face that extends slightly from the periphery of the rotor and that will come in contact with a mail piece upon rotation of the rotor.

The mechanism also has racks 32, one for each print wheel, only one of which is shown in FIG. 4. The rack 32 has gear teeth 33 that engage with the gear teeth of gear 31. Rack 32 has a long portion 34 which rests within a channel of the axle 55 (FIG. 3). Shown in simplified form is mechanism 35 which engages the long portion 34, moving it axially as needed to effect changes in the position of the value wheel 30. The mechanism 35 includes motor 36 coupled to gear 37 which engages with rack 32. It will be appreciated that when rotor 50 rotates so as to imprint postage on a mail piece, rack 32 moves out of engagement with gear 37 (e.g. it moves out of its home position) and is locked by engagement with a locking member omitted for clarity in FIG. 4. When the rotation of the rotor 50 has finished, the rack 32 is once again in engagement with the gear 37, that is to say it is in its home position again. Under normal conditions the rotor 50 is motionless only in its home position; whenever it is not in its home position it is in motion. Generally speaking the only circumstance in which the rotor 50 would be motionless in a position other than the home position is if electric power to the meter 40 is lost during a franking operation, that is, if electric power is lost during the process of printing postage. The design of the meter is such that when power is reapplied the meter will continue its franking cycle until the rotor is once again at its home position.

The mechanical configuration of wheel 30 and rack 32 is shown in greater detail in FIG. 5. Rack 32 runs on guide rod 38, which is fixed to the structure of the rotor 50. Guide rod 38 confines the movement of rack 32 so that it cannot move laterally (that is, in the axial direction of the axle 39 of the value wheel 30) nor can it move vertically (that is, it cannot move closer to the wheel 30 nor downward closer to the axis of the rotor 50). The rack 32 can only move left and right in the figure, which movement is parallel to the axis of the rotor 50.

It will be appreciated that while FIG. 5 shows only one print wheel 30, a typical postage meter has four or more print wheels 30 located on the axle 39. Each print wheel 30 has a corresponding rack 32 and locking arm 60. Each rack 32 has a corresponding guide rod 38, and each locking arm 60 has a corresponding spring 61. In the typical meter there is, however, only a single cam follower 63 which interacts with all the locking arms 60, and only a single cam 62.

A complete discussion of the elements interacting with the value wheel 30 in a typical prior art arrangement requires mention of a locking arm 60. Locking arm 60 pivots so that in the locked position, shown in FIG. 6, the arm 60 engages at least one tooth of the gear 31; here, the preferable choice is shown in which the arm 60 engages two teeth of gear 31. As a result wheel 30 cannot turn. A spring 61 biases the arm 60 into the locked position. In its unlocked position as shown in FIG. 5, the arm 60 is raised and does not impede rotation of the wheel 30. A cam 62 on the main body of the postage meter is positioned to engage a cam follower 63 when the rotor 50 is in its home position. The cam 62 is shaped so that when the rotor 50 is out of its home position (FIG. 6), the spring 61 moves arm 60 into the locked position and the movement of the arm 60 lifts the cam follower 63. In FIG. 6 the cam 62 appears only in phantom, indicating that its position is far from that of cam follower 63 so that it does not engage cam follower 63. The cam follower 63, in its raised position, will then reengage the cam 62 (FIG. 5) when the rotor returns to its home position.

The purpose of the arm 60 is to keep the uppermost face of wheel 30 centered in its position throughout the rotation of the rotor; this ensures that the printed digit on the mail piece will be clearly printed on the mail piece and not shifted upwards or downwards due to unintended rotation of wheel 30.

Mechanism 35 has sensors, omitted for clarity in FIG. 4, which provide a very high degree of confidence that the gear 37 is in the desired position. As a result, so long as the linkage of rack 32 and related pieces is intact, the value wheel 30 will be in the desired position.

It might be suggested that a wrongdoer could "jog" a value wheel 30 into an incorrect relation to its respective rack 32. The postulated misconduct would be a series of steps: the wrongdoer would repeatedly cut off power to the postage meter 40 during printing cycles, until by chance the rotor 50 would stop with the value wheels 30 accessible at the cover 44. Next, the wrongdoer would hold the rotor 50 in place from angular movement. The wrongdoer would then lift the arm 60. Finally, the wrongdoer would apply a very large impulse of force to one or more of the wheels 30, in an attempt to rotate them. This is not easy because each wheel 30 is held from rotating due to gear engagement with the rack 32, which as mentioned above is locked when out of the home position by the locking device.

Notwithstanding the improbability and difficulty of the steps just described, it might be suggested that the wrongdoer could succeed in displacing a wheel 30 by some angular amount, so that, say, a "4" is uppermost when previously a "3" was uppermost. To do this, the wrongdoer would have to succeed in deforming the guide rod 38 so much that the rack 32 would move downwards with its teeth coming out of engagement with the teeth of the gear 31.

Many factors suggest that even if the wrongdoer were to succeed at this unlikely enterprise the wrongdoing would eventually be detected. For example, the large impulse to the wheel 30 could damage the printing face 45 of the wheel, so that imprinted postage values containing that digit would advertise the misconduct. One or more of the teeth of the gear 31 could be broken, disabling the meter. The guide rod 38 could be deformed, an event that could be detected during the periodic examinations required of postage meters. Finally, everyone using the meter would have to be told that setting is strange—for example that when the meter is set, the "tens" digit has to be set to a value that is too small by ten cents.

Notwithstanding these factors, it is desirable to make mechanical provisions that eliminate even the remote chance of a wrongdoer jogging a value wheel.

Returning now to FIG. 1, it was mentioned that the door or cover 44 is openable so that the user may adjust the date or remove or replace the die plate (advertising plate). With some prior art arrangements of door design it might be possible to open the door even when the rotor is not in the home position, without leaving telltale marks that would indicate to someone inspecting the meter that the door had been opened. This might reduce the likelihood of meter tampering being detected. It would thus be desirable for an improved door interlock to be provided making it very difficult to open the door at a time when the rotor is not in the home position, without causing telltale damage to the door or rotor.

SUMMARY OF THE INVENTION

In accordance with the invention, a locking cam follower is provided so that locking arms on the print wheels of a postage meter are able to lock the wheels from unintended movement when the print rotor is out of its home position. Stiff runners are provided below guide rods of setting racks in the rotor so that the racks cannot be displaced away from the value wheels. A sensor is placed on the rotor cover with the meter software set up to keep a print cycle from starting if the cover is open. A cam on the rotor makes it impossible to open the cover when the rotor is out of the home position. A latch holds the cover shut, and the only way the latch can be released is if the meter software releases it, for example by sliding a rack to a position that triggers the latch. Cogs and cog teeth are used instead of gears and gear teeth to reduce the possibility of unintended movement of the value wheels. Rotating disks lock the racks when the rotor is not in the home position.

BRIEF DESCRIPTION OF THE DRAWING

The invention will be described with respect to a drawing, of which:

FIG. 10 shows a portion of a print wheel rack mechanism according to the invention, with a reinforcing beam replacing a guide rod;

FIG. 11 shows in cross section a swinging rotor cover having a position switch that is not easily defeated by a user;

Where possible, like reference numerals have been used to identify like elements of the various figures.

DETAILED DESCRIPTION

Figure 6:
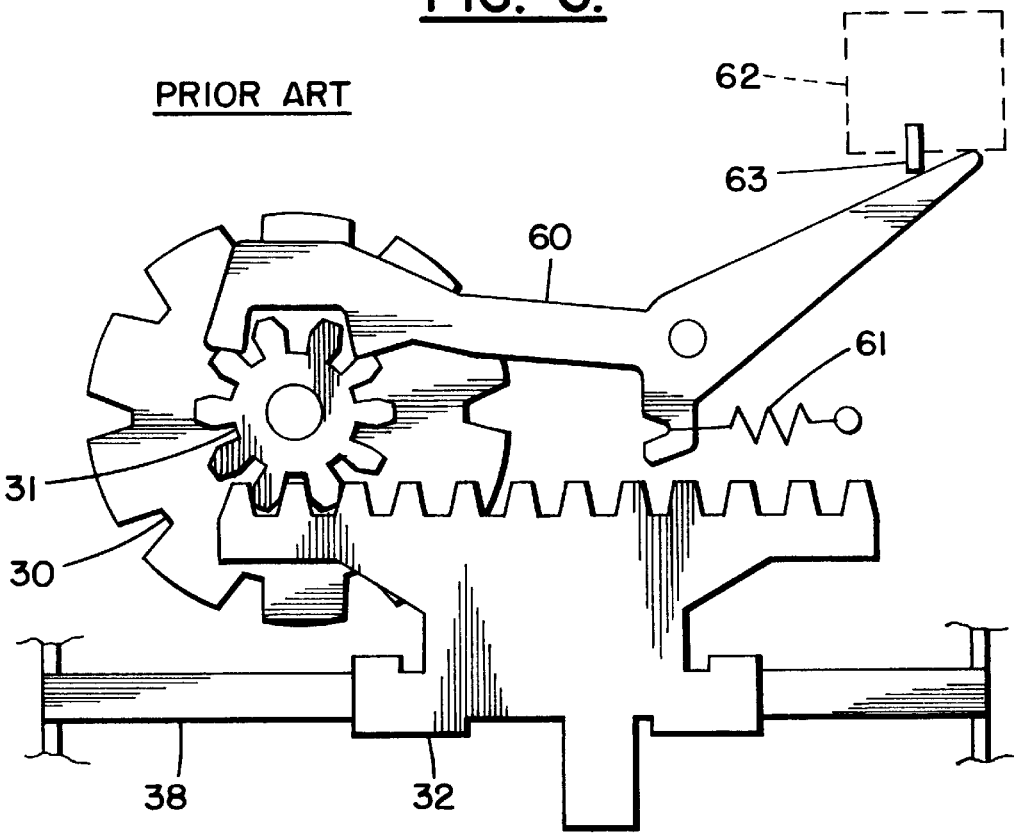
FIG. 6. PRIOR ART
FIG. 6 shows the mechanism of FIG. 5 but with the locking arm in its locked position.
Figure 7:
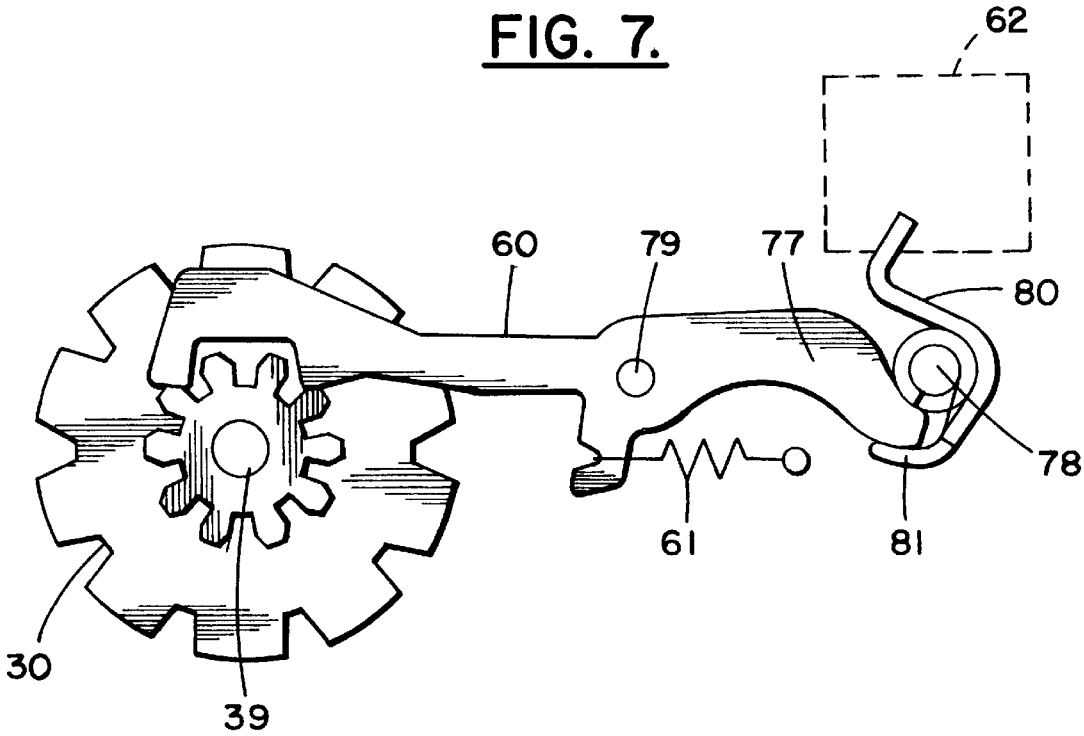
FIGS. 7 and 8 show mechanisms according to the invention corresponding to the mechanisms of FIGS. 5 and 6 respectively, with a locking cam follower engaging the locking arms.

Turning now to FIG. 7, there is shown in some detail a portion of the improved postage meter in a view corresponding to that of FIG. 6. Locking cam follower 80 is spring-loaded clockwise by a spring, omitted for clarity in FIG. 7. The cam follower's extreme clockwise movement holds each of the locking arms 60 in its locked (fully counterclockwise) position as shown. It will be appreciated that feature 81 of the cam follower 80 serves to lock each locking arm 60 into that position, so that even if one were to attempt to lift the arm 60 it would not move upwards. The housing of the meter is such that cam follower 80 is unreachable even if the cover 44 were opened. A wrongdoer would thus be unable to rotate the wheel 30.

Figure 8:
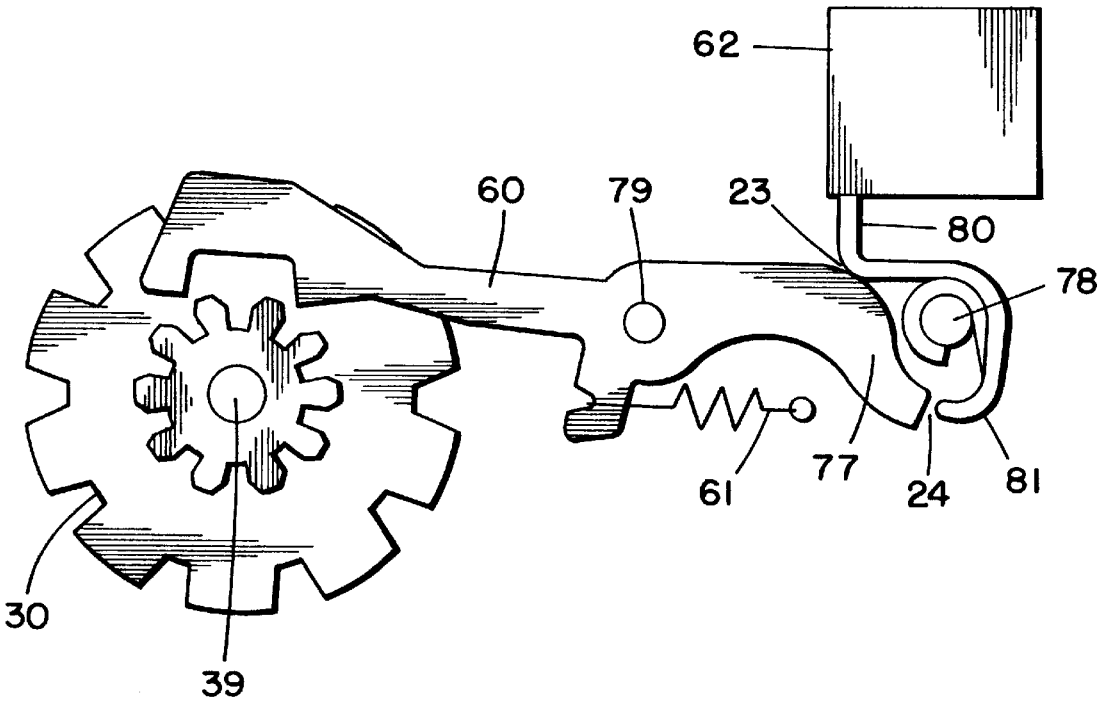

Cam follower 80 of FIG. 7 otherwise acts much like cam follower 63 of FIG. 6. As shown in FIG. 8, when the rotor 50 is in its home position, the cam 62 engages the cam follower 80 to raise the arms 60. The cam follower 80 has a point of contact 23 with the locking arm 60.

As described above in connection with FIG. 5, it will be appreciated that FIG. 7 shows only one of several print wheels 30 sharing axle 39. For each print wheel 30 there is a locking arm 60 and spring 61. A single cam follower 80 engages all the locking arms 60 at respective points of contact 23. Just as in FIG. 5, there is one cam 62, shown in phantom because it is not engaged with cam follower 80.

When the rotor 50 rotates past the home position for example for printing of postage, the cam 62 is no longer engaging cam follower 80. Cam follower 80, urged upwards by a spring omitted for clarity in FIG. 8, moves clockwise and away from its point of contact 23. A point of contact 24 keeps the cam follower from rotating fully clockwise until the last of the locking arms 60, each urged by its respective spring 61, drops into place over the teeth of the respective print wheels 30. When the last of the locking arms 60 drops into place (urged by springs 61) then none of the points of contact 24 blocks the clockwise rotation of the cam follower 80. The cam follower 80 is then free to move clockwise, as urged by its spring (not shown in FIG. 8), and does so, resulting in the positions shown in FIG. 7. Feature 81 holds the arms 60 in their fully counterclockwise positions. Because cam follower 80 is not accessible to the user, the print wheels 30 are thereby locked quite securely during franking.

Figure 24:
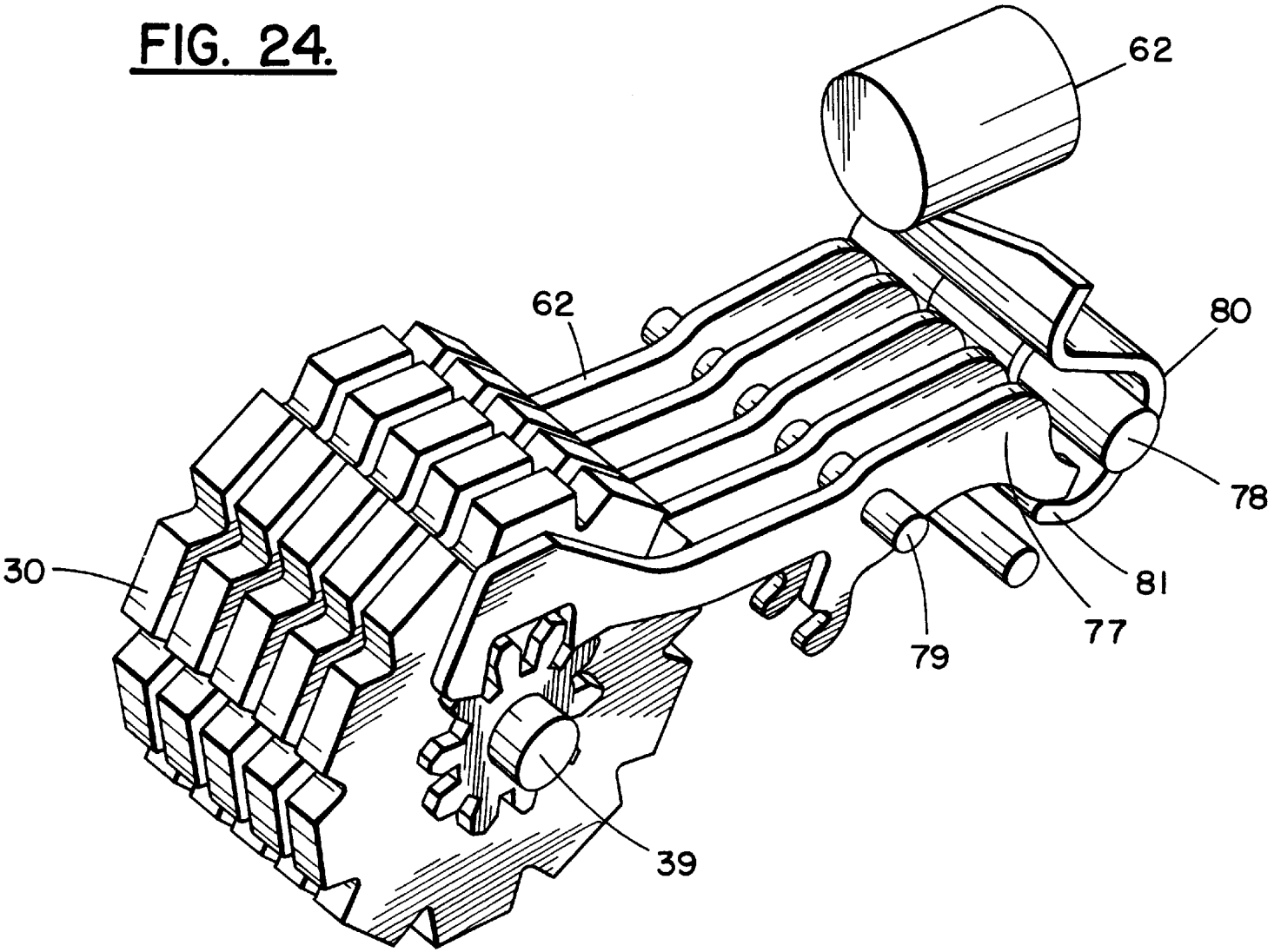
FIG. 24 shows in perspective view the cam and locking cam follower of FIG. 8.
Figure 25:
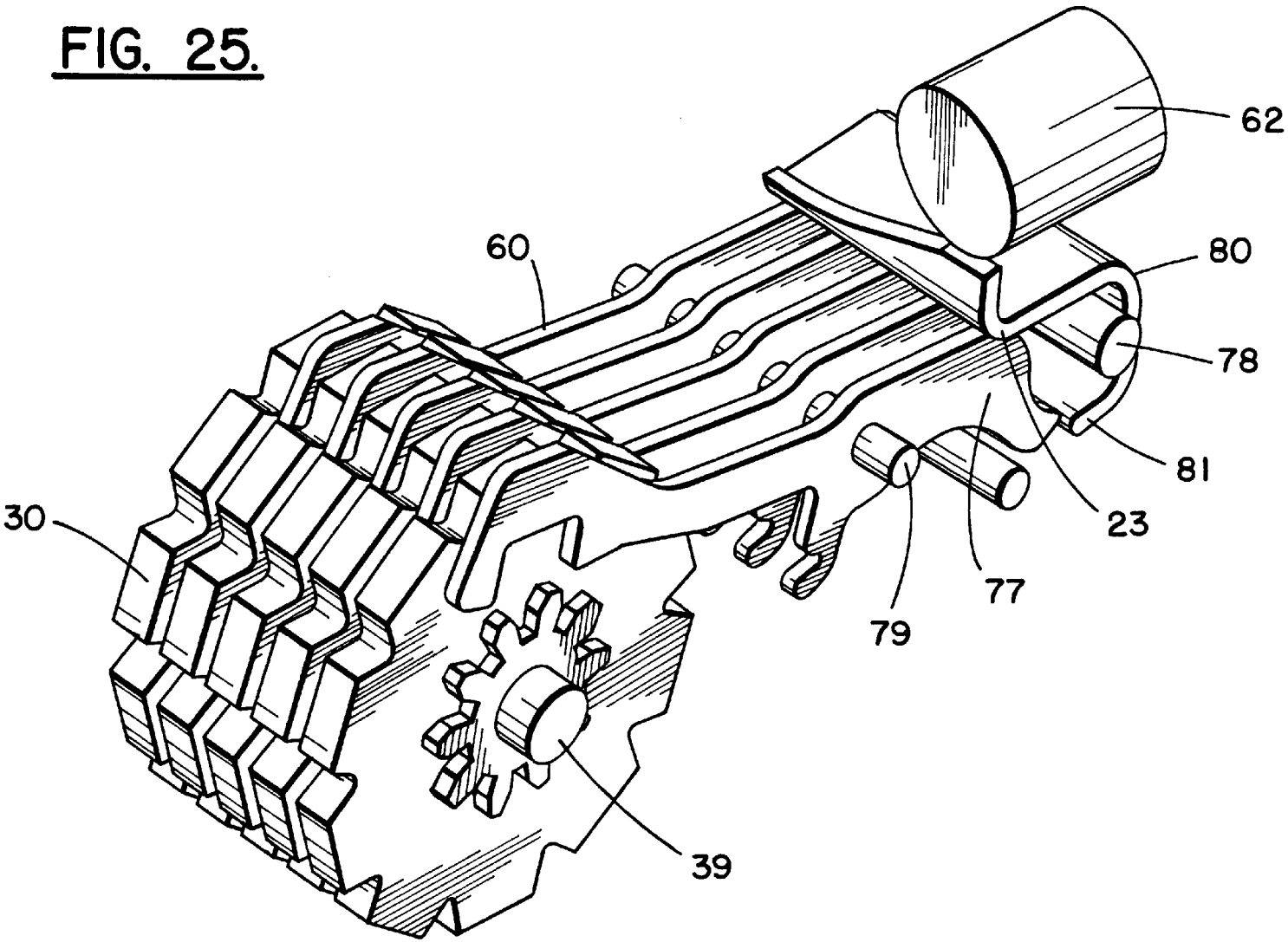
FIG. 25 shows in perspective view the cam and locking cam follower of FIG. 7.
Figure 26:
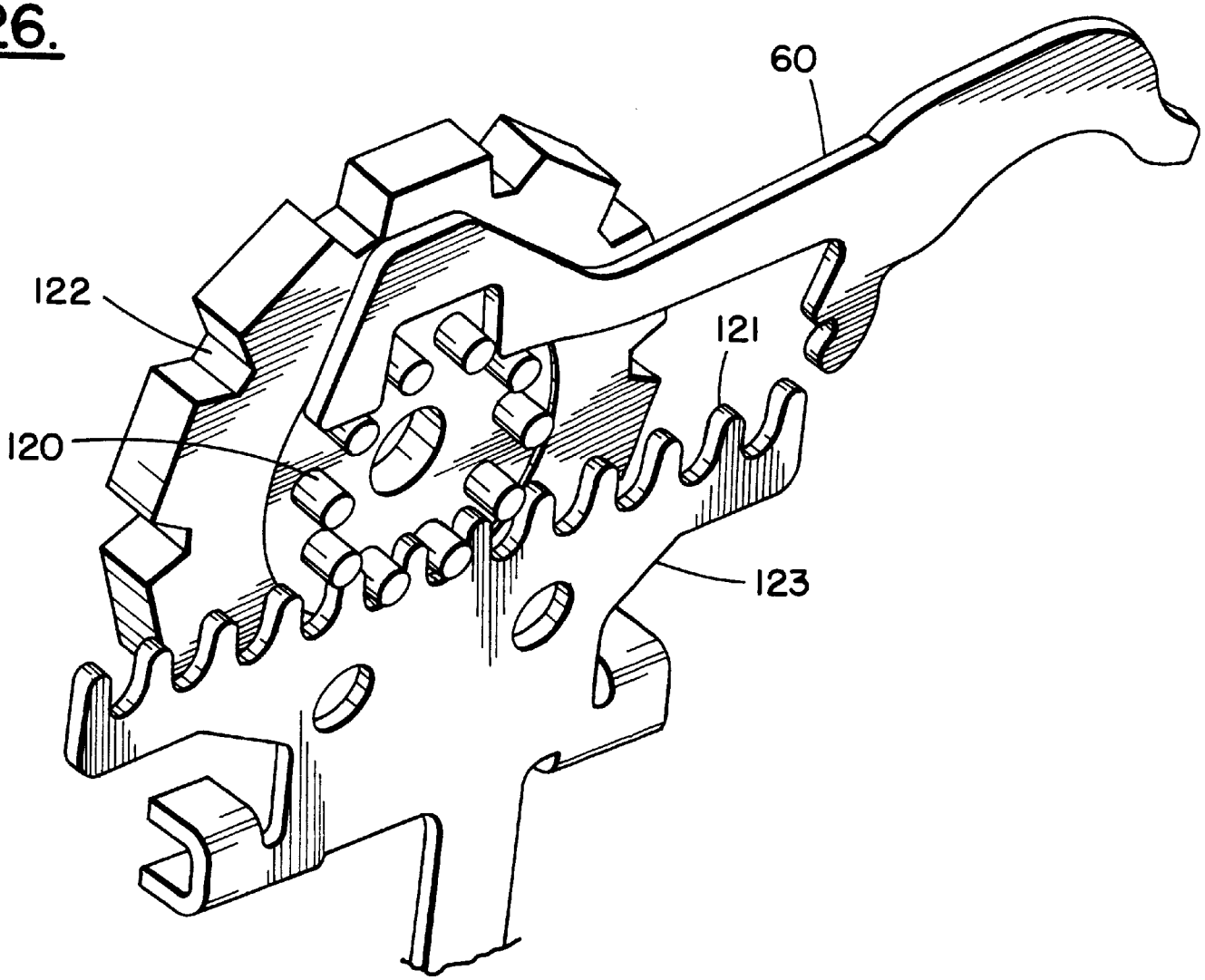
FIG. 26 shows in perspective view the cogs and cog-rack of FIG. 16.

In this embodiment, as shown in perspective view in FIGS. 24 and 25, it will be appreciated that the value wheels 30 rotate on a first common axle 39 lying within a plane perpendicular to the axis of the rotor 50, the arms 60 rotate on a second common axle parallel to the axle 39, and the cam follower 80 rotates on a third axle 78 parallel to the second axle 79. The arms 60 having portions 77 extending toward the third axle 78. Turning back to FIG. 7, it will be appreciated that the cam follower 80, in a cross section taken perpendicularly to its axle 78, is substantially C-shaped with feature 81 defining a cavity, the cam follower 80 disposed so that in its first position the extended portions 77 of the arms are within the cavity.

It will also be appreciated that the benefit of the locking cam follower 80, shown in FIGS. 7 and 8, obtains even if the wheels 30 are set by means other than racks 32. For example, the wheels 30 could be set by gears or rotating shafts and the locking cam follower 80 would still provide its benefits. The invention, as embodied with the locking cam follower 80 and locking arms 60, could thus easily be modified by those skilled in the art to include obvious variations departing from the precise structure shown in the figures without deviating in any way from the invention.

Figure 19:
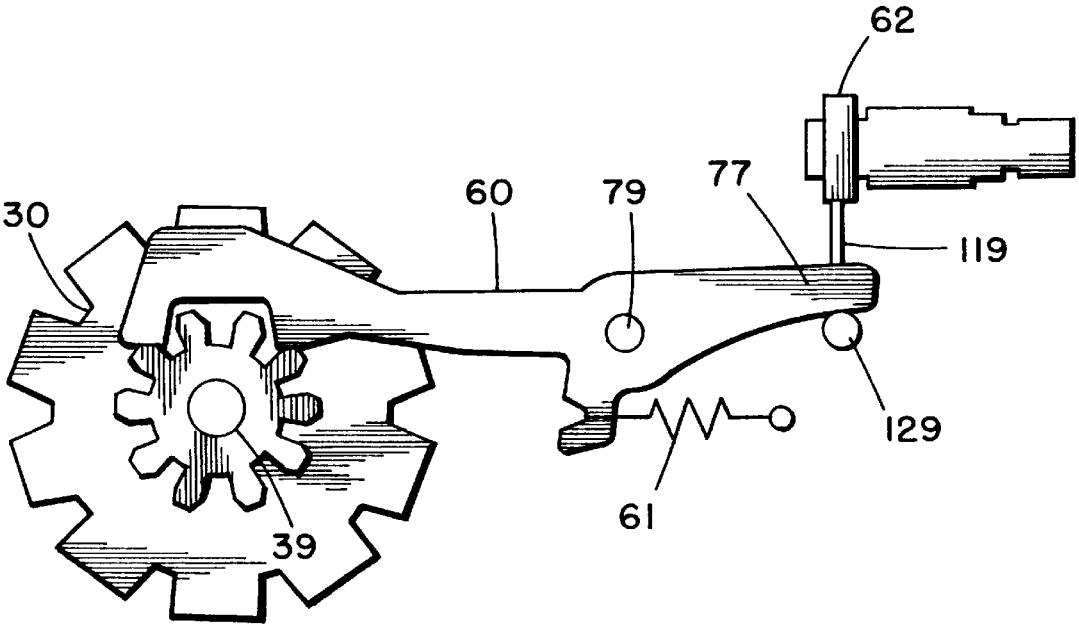
FIG. 19 shows a portion of the pin-type embodiment of the invention.

Another embodiment of the cam follower and locking arms of the print rotor will now be described. In FIG. 19 is shown a print wheel locking mechanism which at first glance looks much like that of prior art FIG. 6. Locking arm 60 is urged by spring 61 into engagement with teeth of the gear of wheel 30. Cam 62 releases the locking arm 60 when the rotor is in its home position.

The mechanism according to this embodiment differs, however, from that of prior art FIG. 6 in several important respects. Turning again to FIG. 19, a locking pin 129 is provided, which moves into and out of the page as shown in FIG. 19. The position of locking pin 129, as will be described below, determines whether or not the locking arms 60 are free to move clockwise if so urged. If pin 129 is in the locked position, then the arms 60 are fixed in the position shown in FIG. 19 and the print wheel 30 cannot move. (As was mentioned above with respect to FIG. 5, there are actually four or more print wheels 30 in the apparatus of FIG. 19 but only one is shown for clarity.) If the locking pin is in its unlocked position, then the arms 60 may be urged clockwise, for example by the cam follower 119.

Figure 20:
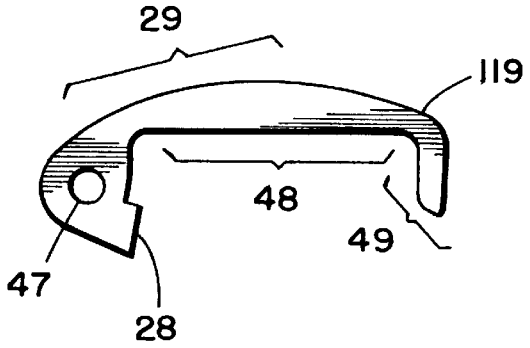
FIG. 20 shows in plan view the cam follower of FIG. 19.
Figure 21:
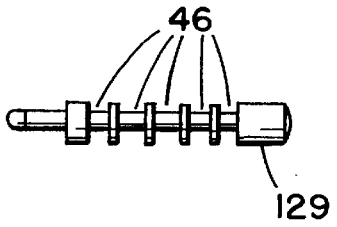
FIG. 21 shows in plan view the sliding pin of FIG. 19.

Cam follower 119, which was shown in cross section in FIG. 19, is shown in plan view in FIG. 20. The follower pivots on an axle 47, which in an exemplary embodiment is parallel to the main axle of the print rotor 50. Feature 28 defines the extent of counterclockwise rotation of the follower relative to the print rotor. Feature 29 defines the interaction of the cam follower 119 with the cam 62. Feature 48 defines the interaction of the cam follower 119 with the locking arms 60. Finally, feature 49 defines the interaction of the cam follower 119 with the locking pin 129. FIG. 21 shows the locking pin 129, which has regions of smaller diameter 46. The interactions of the cam follower 119 with the locking pin 129 and the other moving parts of the rotor 50 will now be described in some detail.

Figure 22:
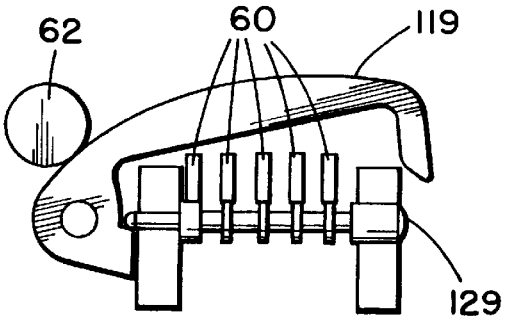
FIG. 22 shows in cross section the mechanism of FIG. 19 as the cam approaches the cam follower.

In FIG. 22 a cross section is shown of the rotor 50, showing the locking pin 129, the cam follower 119, the cam 62, and portions of a typical five locking arms 60. The locking pin 129 is in its locked position, with each of locking arms 60 riding on high portions of the locking pin 129. In FIG. 22 the locking pin is shown in its rightmost position, urged there by a spring omitted for clarity in FIG. 22. As mentioned above locking arms 60 are also urged upwards (in FIG. 22) due to springs 61 (omitted for clarity in FIG. 22) but the locking pin 129 provides a positive block against downward movement of the arms 60. The mechanical positions shown in FIG. 22 are typical for the rotor 50 any time it is away from its "home" position. FIG. 22 shows the particular case where the rotor 50 is "almost home", i.e. it has almost completed a franking (printing) cycle. As shown in FIG. 22 cam 62 has only just lightly touched cam follower 119 and has not yet caused it to move. Defined relative to an arbitrary starting point, rotor 50 has rotated in FIG. 22 to an angle of about 31 degrees.

Figure 22A:
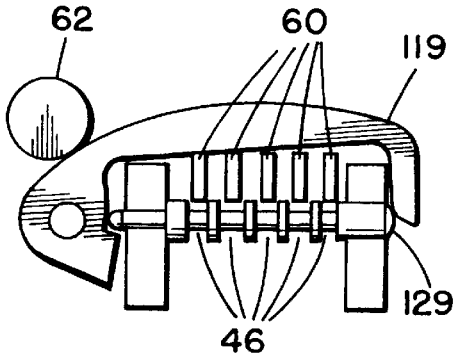
FIG. 22*a* shows in cross section the mechanism of FIG. 19 as the cam has partially engaged the cam follower.

As the rotor 50 continues to rotate, the relative positions of the cam 62 and cam follower 119 reach that shown in FIG. 22*a*. Cam follower 119 has been pushed downwards in FIG. 22*a*, toward pin 129, sufficiently to push pin 129 fully leftwards in FIG. 22*a*. Cam follower 119 has only just lightly touched the leftmost arm 60 and has not yet caused it to move. Because of the leftwards movement of pin 129, the regions of smaller diameter 46 are now aligned with arms 60 and would permit downward movement thereof if arms 60 were so urged. It is expected, however, that arms 60 would remain upwards due to the urging of springs 61 (not shown in FIG. 22*a*). In an exemplary embodiment the relative positions of cam 62 and cam follower 119 shown in FIG. 22*a* are reached when the rotor 50 has rotated to an angle of about 36 degrees, or about five degrees further than the angle of FIG. 22.

Figure 23:
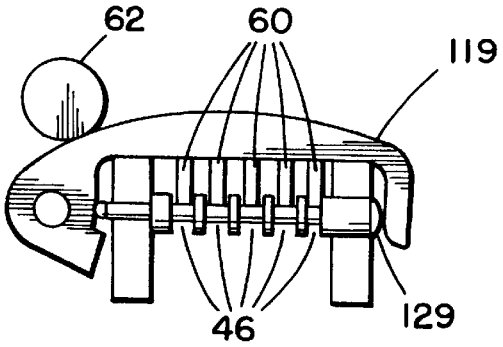
FIG. 23 shows in cross section the mechanism of FIG. 19 when the cam has fully engaged the cam follower.

As the rotor 50 continues to rotate, the relative positions of the cam 62 and cam follower 119 reach that shown in FIG. 23. Cam follower 119 has been pushed downwards quite far by the cam 62. Pin 129 had already been moved fully leftwards in FIG. 22*a* and remains fully leftwards in FIG. 23. The full downward movement of cam follower 119 also pushes all of the arms 60 fully downwards into the regions of smaller diameter 49. As a consequence (returning to FIG. 19) the print wheels are unlocked and are free to rotate as controlled by their respective setting mechanisms such as racks 32.

At a later time, as the rotor 50 rotates past the home position for example for printing of postage, the cam 62 is no longer engaging cam follower 119. Cam follower 119, urged upwards by a spring omitted for clarity in FIG. 23, moves upwards and away from pin 129. The locking arms 60, each urged by its respective spring 61, drop into place over the teeth of the respective print wheels 30, and when the last of the locking arms 60 drops into place the pin 129 is free to move rightwards, as urged by a spring not shown in FIG. 129, and does so. Because the cam follower 119 is not accessible to the user, the print wheels 30 are thereby locked quite securely during franking.

It will thus be appreciated that in this embodiment there is what may be termed a sliding pin 129 having regions of reduced height 46. In this embodiment the value wheels 30 rotate on a first common axle 39 (see FIG. 19) lying within a plane perpendicular to the axis of the rotor 50, the arms 60 rotate on a second common axle 79 parallel to the first axle 39, and the sliding pin 129 slides along a path parallel to the second axle 79. Portions 77 of the arms 60 extend toward the sliding pin 129. The cam follower 119 may be described as being operatively coupled with the sliding pin 129 such that when the cam follower 119 is engaged with the cam 62, the cam follower 119 urges the sliding pin 129 into its second position (into the page in FIG. 19). As shown in FIG. 22*a* the sliding pin 129 is disposed so that in its second (leftwards) position the extended arm portions 77 of arms 60 are juxtaposed with the regions of reduced height 46 of the sliding pin 129. As shown in FIG. 23 the sliding pin 129 is also disposed so that in its first (rightwards) position portions 77 of the arms 60 are juxtaposed with portions of the sliding pin 129 other than the regions of reduced height. As mentioned previously, the mechanism further comprises a spring (not shown in FIG. 22 for clarity) urging the sliding pin 129 toward its first position.

As was stated above with respect to FIGS. 7 and 8, it will be appreciated that the benefit of the cam follower 119 and locking pin 129, shown in FIGS. 19–23 obtains even if the wheels 30 are set by means other than racks 32. For example, the wheels 30 could be set by gears or rotating shafts and the locking cam follower 119 and locking pin 129 would still provide their benefits. The invention, as embodied with the locking cam follower 119 and locking pin 129 and locking arms 60, could thus easily be modified by those skilled in the art to include obvious variations departing from the precise structure shown in the figures without deviating in any way from the invention.

It will also be appreciated that although the member 129 is characterized as a pin with regions of smaller diameter, one skilled in the art could readily substitute members of other shapes without departing in any way from the invention. For example, the member would not have to be round, as shown in FIG. 19, but could have some other overall cross section such as a "D" shape or a square or triangle, without deviating from the invention. The regions 46 which permit downward movement of the arms 60 would not have to be regions of reduced diameter, but could merely be regions of reduced height at the top of the member as shown in FIG. 23, again in no way departing from the invention. The characterization of the member 129 as a pin, and the characterization of its regions 46 as regions of reduced diameter, merely reflect the shape of member 129 which is thought to be easiest to fabricate, and should not be understood as limiting the invention.

It will thus be appreciated that what has been provided in the above two embodiments of the invention is a plurality of locking arms 60, each locking arm 60 corresponding to a respective one of the value wheels 30, each arm 60 movable between a first position engaging the gear portion of the respective value wheel 30 and blocking rotation thereof, and a second position away from the value wheel 30 and permitting rotation thereof. In each embodiment there is also a locking member movable between a first position and a second position, the locking member biased toward the first direction, the locking member operatively coupled with the arms 60 such that in the first position the arms 60 are locked in respective first positions, and in the second position the arms 60 are moved to respective second positions. The secure housing is disposed such that when the rotor is in a position in which the value wheels are not within the secure housing, the locking member is within the secure housing.

Figure 5:
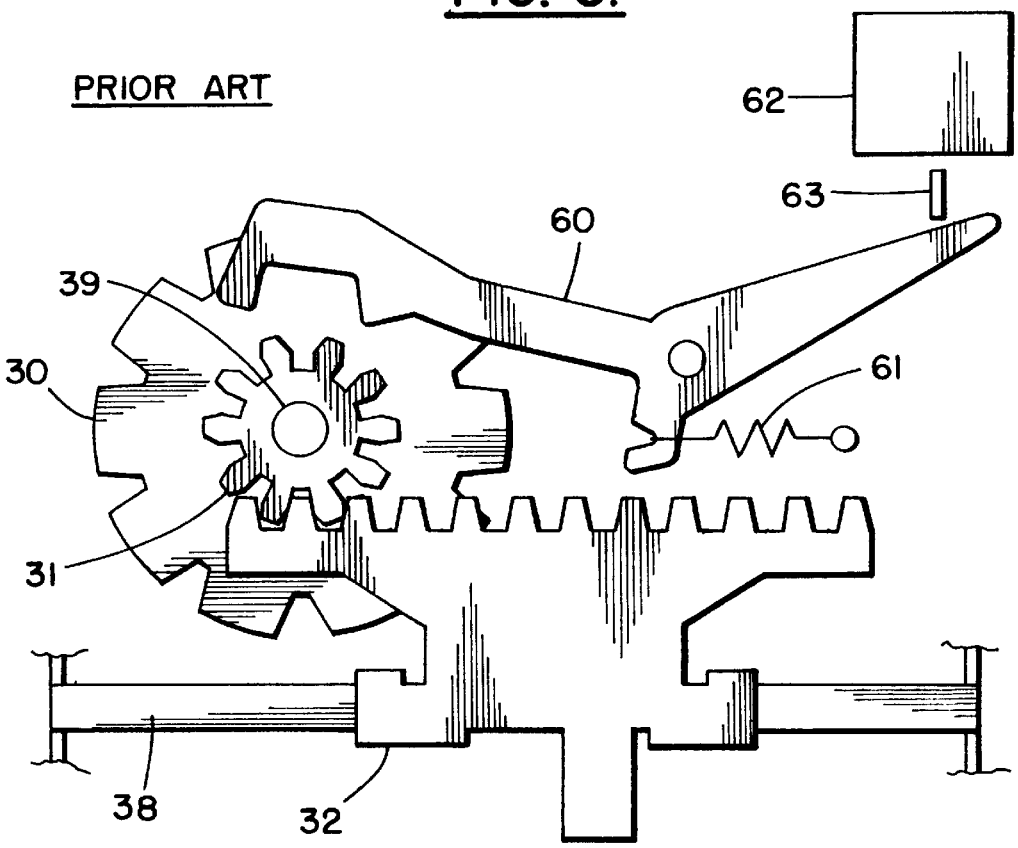
FIG. 5. PRIOR ART
FIG. 5 shows a portion of the print wheel mechanism of FIG. 4 in greater detail, with a locking arm in its unlocked position.
Figure 9:
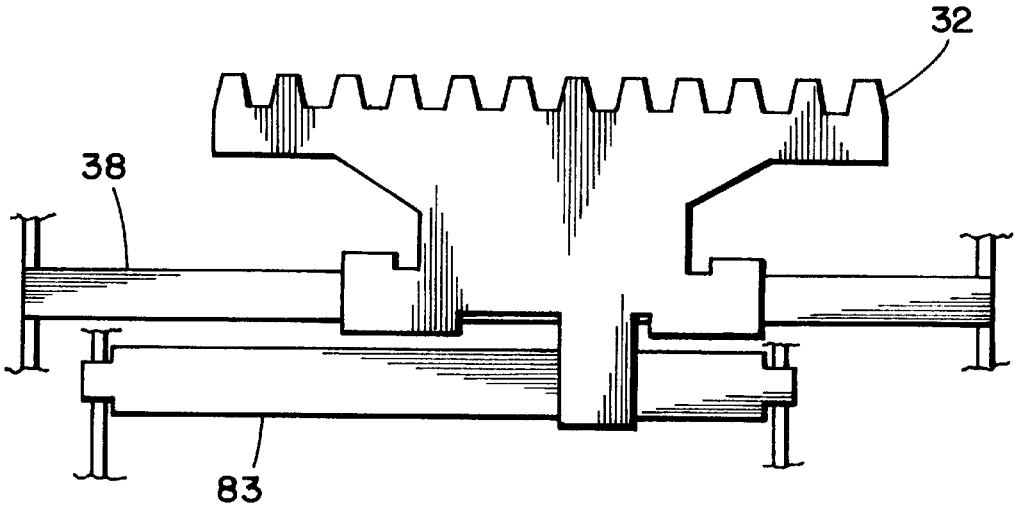
FIG. 9 shows a portion of a print wheel rack mechanism according to the invention, with a reinforcing beam augmenting a guide rod.

FIG. 9 shows another aspect of the invention, in which a stiff reinforcing beam 83 is below and parallel to the guide rod 38, and which is likewise fixed to the structure of the rotor 50, in this way differing from the structure of FIG. 5. The beam 83 has a cross section in a plane perpendicular to the rotor axis that is greater in the radial direction relative to the rotor axis than it is in the other dimension. Stated differently, in FIG. 8 the beam is taller than it is thick. The beam 83 provides substantial protection against downwards deformation of the guide rod 38 during any attempted jogging of value wheels. It is preferably made of steel.

Figure 27:
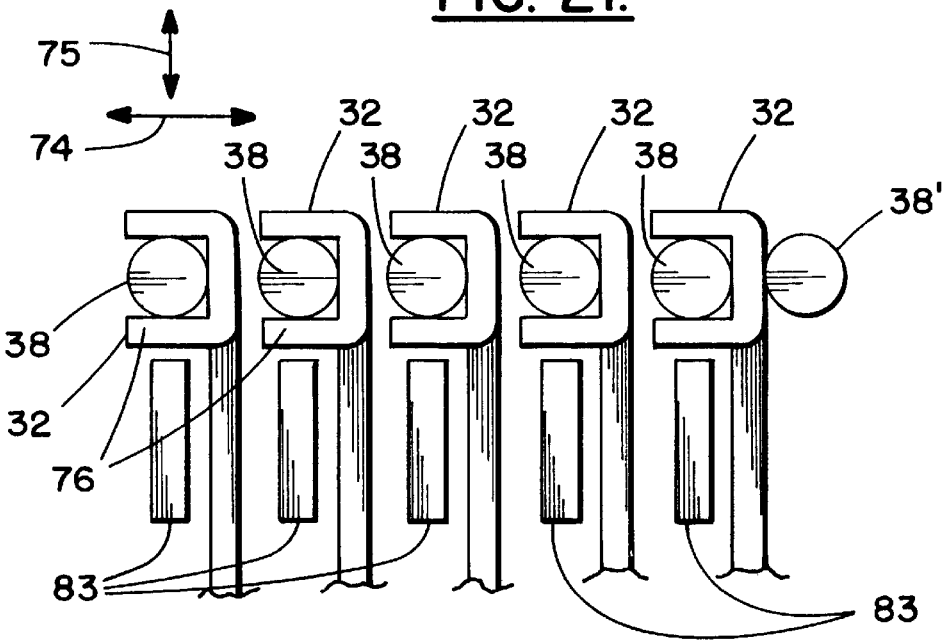
FIG. 27 shows in cross-section the guide rods, racks, and reinforcing beams of FIG. 9.

The apparatus of FIG. 9 will now be described in cross section. As mentioned above, a typical postage meter has at least four print wheels, and for each print wheel there is a corresponding rack 32. FIG. 27 shows in cross section a typical arrangement where five racks 32 are employed. For clarity the upper portion of each rack 32 (i.e. the portion engaging with the print wheel gear) is omitted. Each rack 32 runs on a corresponding guide rod 38. Each rack 32 has C-shaped portions that partially surround the corresponding guide rod 38 as shown. Auxiliary guide rod 38' is also provided, and the six guide rods together confine the five racks with respect to movement to the left and right in FIG. 27. The structural elements of FIG. 27 thus far described comport with the prior art, but according to the invention, reinforcing beams 83 are also provided, thus differing from the prior art. Each beam is, as mentioned above, much taller in FIG. 27 than it is wide, providing substantial protection against unintended movement of a rack downward in FIG. 27.

Described differently, what is provided in this aspect of the invention is a plurality of racks 32 shown in FIG. 27 corresponding to respective value wheels 30, the racks 32 moving along substantially parallel guide rods 38 to engage with and rotate the value wheels 30, and reinforcing beams 83 corresponding to respective guide rods 38, each beam 83 being substantially parallel to its respective guide rod 38. It is noted that a portion 76 of each rack 32 lies between its respective guide rod 38 and respective beam 83. That portion 76 of the rack 32 is what would come in contact with the beam 83 if the rack 32 were moved forcibly downwards in FIG. 27. And it will be appreciated that each beam 83, taken on a cross section perpendicular to its respective guide rod 38, defines a first dimension 75 lying within the plane containing the beam and the guide rod, and a second dimension 74 perpendicular thereto, and that the strength of the beam comes in part from the fact that the first dimension 75 of the beam 83 is greater than the second dimension 74 of the beam 83. The spatial relationship between the guide rods 38 and the beams 83 of FIG. 27 and the value wheels 30 may be characterized as follows. The wheels 30 in a typical embodiment are substantially identical in diameter and rotate on a common axle. (In fact the wheels in the center of the axle are typically slightly larger in diameter than the ones at the ends of the axles, but for this discussion such wheels are termed to be "substantially identical in diameter".) The guide rods 38 are substantially coplanar and the axle of the wheels 30 is substantially parallel to the plane of the guide rods 38. The beams 83 lie within a plane substantially parallel with the plane of the guide rods 38. As mentioned above, a portion 76 of each rack 83 lies between the two planes.

FIG. 10 shows an alternative embodiment of this aspect of the invention. In FIG. 10 it is seen that the guide rod 38 (of FIG. 9 or FIG. 5) has been entirely replaced with a runner or beam 83 that is taller than it is wide, and is thus quite stiff against deformation away from the value wheel 30. The rack of FIGS. 5 or 9 cannot be used in FIG. 10, but must be modified so as to run on the beam 83 in much the same way as it would on the guide rod 38. It will be appreciated that in this embodiment of the invention, what is provided is a postage meter having a plurality of value wheels 30 rotatable in planes disposed parallel to each other, and a setting means (here, racks 32 and related mechanisms) engageable with the wheels 30. The racks 32 move along substantially parallel beams 83 to engage with and rotate the value wheels 30. Each beam 83, taken on a cross section perpendicular to its length, the cross section defining a first dimension lying within a plane parallel to the planes of the wheels 30 (within the page in FIG. 10), and a second dimension perpendicular thereto (into and out of the page in FIG. 10), is characterized in that the first dimension is greater than the second dimension. It will also be appreciated that in the apparatus of FIG. 10, the wheels are substantially identical in diameter (as mentioned above, the middle wheels may be slightly larger in diameter than the wheels at the end of the axle 39) and rotate on a common axle 39, wherein the beams 83 are substantially coplanar, and the axle 39 is substantially parallel to the plane of the beams 83.

Figure 13A:
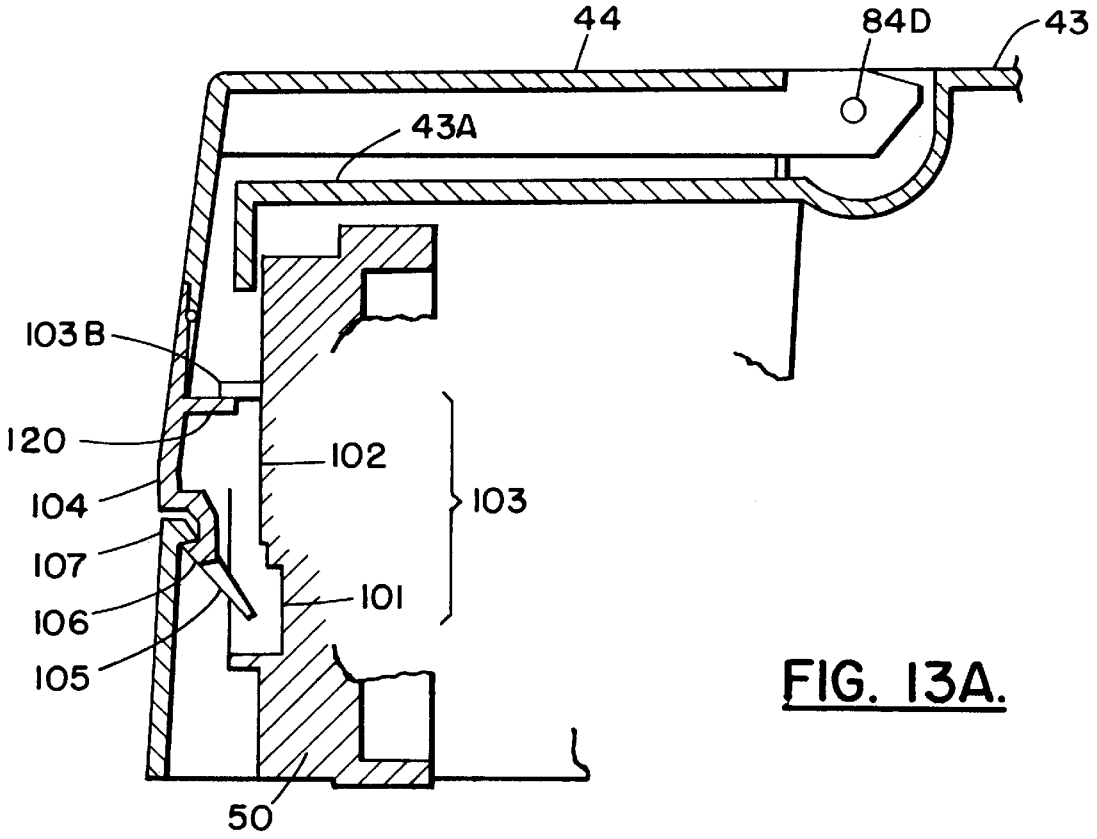
FIG. 13A shows in cross section a swinging rotor cover having a compound hinge and a cam-controlled cover release latch, in the closed position.
Figure 13B:
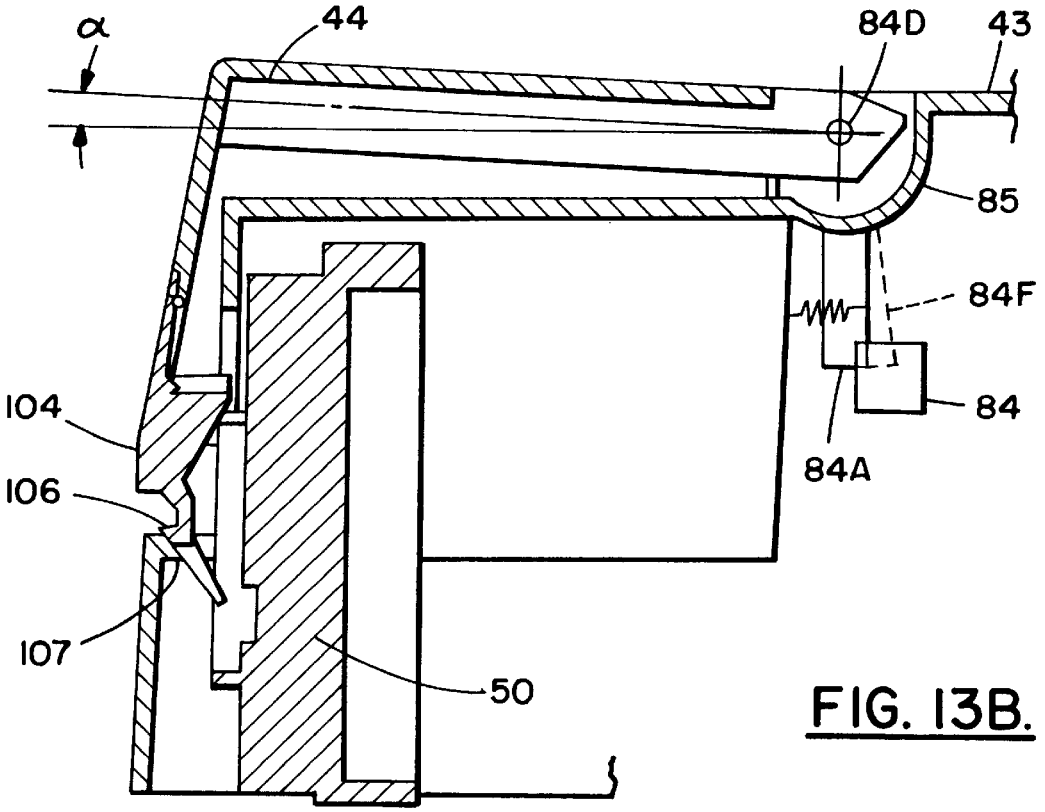
FIG. 13B shows in cross section the swinging rotor cover of FIG. 13A in a slightly open position.

In FIG. 13B is shown a switch 84 on the cover 44, in a cross-sectional view of case 43 and cover 44. In the prior art, a Hall-effect switch has been used to monitor the cover position. In the prior art the type of switch used and its location make it usable only for advisory purposes (e.g. to silence a reminder to check the date setting as in U.S. Pat. No. 4,283,721 to Eckert or U.S. Pat. No. 4,347,506 to Duwel) and not for security purposes. For example, many Hall-effect switches can be tricked by placing a strong magnet nearby. And if, as in the prior art, a cover switch is exposed to user access when the cover is open, then the switch can be defeated by simple mechanical means. The switch 84 is a non-Hall-effect switch, such as a micro switch (as shown) or LED-phototransistor optical sensor. Furthermore, the switch 84 is placed so that it is not accessible to the user even if the cover 44 is open, for example behind a wall 85.

It will be appreciated, then, that the cover 44 is movable between a first position in which a user has access to the rotor 50 ("open") and a second position in which the user has no access to the rotor 50 ("closed"), and the switch 84 is positioned with respect to the cover 44 to generate a signal indicative of the cover 44 being in the first position. The signal is made available as an input to the processor of the meter. The secure housing 43 further characterized in that the switch 84 is within the secure housing 43 (e.g. by means of wall 85) whereby the user is substantially unable to affect the generation of the signal.

In the case where the switch 84 is a phototransistor, a light-emitting diode is provided nearby thereto and a movable barrier preferably formed as part of the cover 44 selectively blocks light therebetween.

Figures 12, 17, 18:
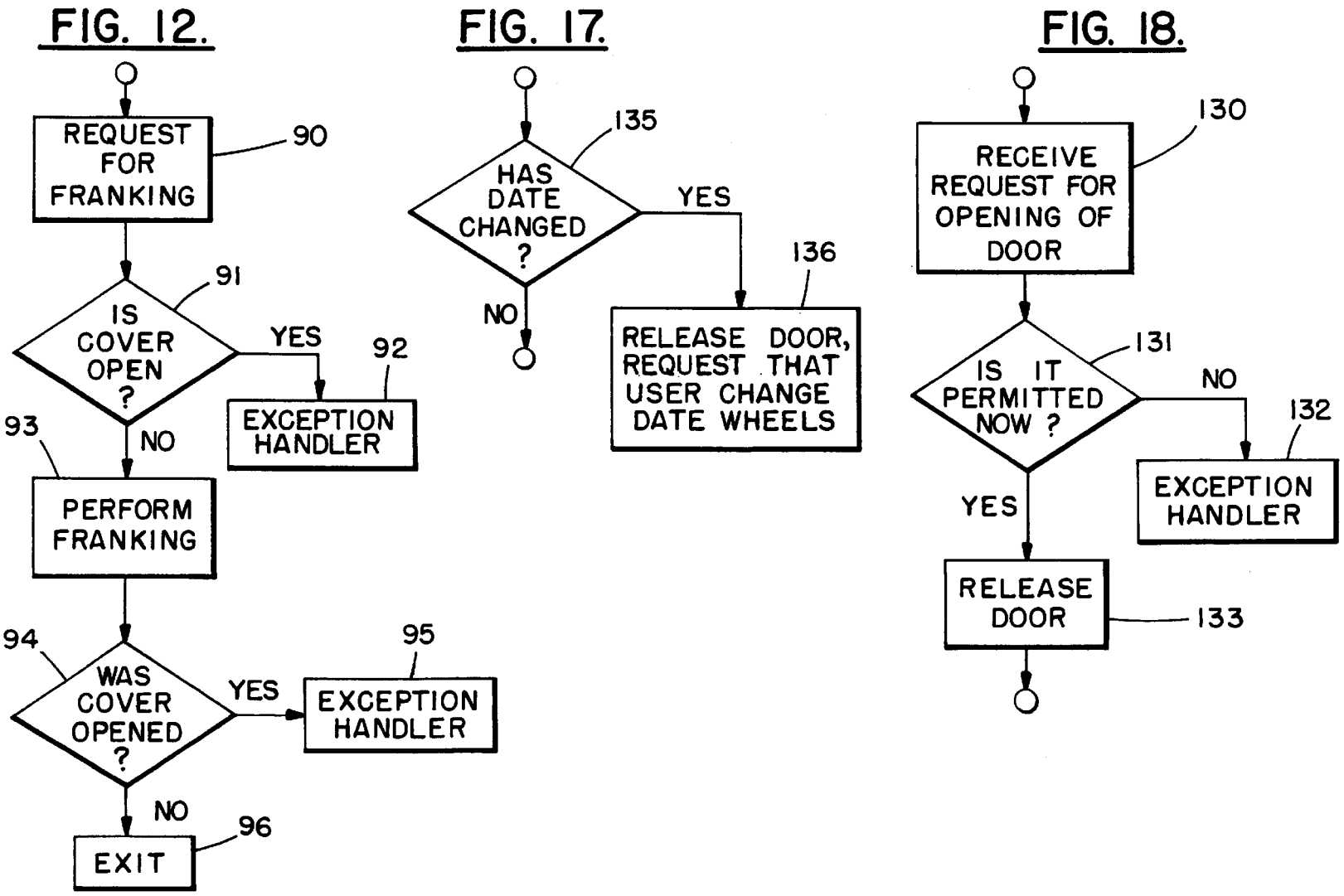
FIG. 12 depicts in flowchart form a method for handling the event of the cover being opened before or during a franking (postage printing) operation.
FIG. 17 depicts in flowchart form a method for use with the automatically actuated rotor cover in the event the date has changed.
FIG. 18 depicts in flowchart form a method for use with the automatically actuated rotor cover in the event a user requests that the door be opened.

The software of the postage meter makes use of the signal from the switch in the manner set forth in FIG. 12, which is a simplified flowchart of a portion of the software thereof. When a request for franking is presented (for example, when a mail piece activates a trigger in the path of travel thereof) the processor checks the signal from the cover switch 84. If the cover 44 is open, an exception handler 92 is invoked which preferably asks the user to close the cover 44. There are relatively few reasons to open the cover 44, so the usual expected situation is that the door 44 is closed. In that case, franking proceeds as in box 93. Stated differently, the processor executes a stored program, and the stored program is such that printing of postage does not occur when the processor receives the signal indicative of the cover being open.

Optionally a flip-flop (omitted for clarity in FIG. 11) can be provided that will latch the signal from the switch 84. If so, then optionally as shown in box 94 a check may be made to determine whether the cover was opened. If it was, an exception handler 95 is invoked. Typically a log is kept of the number of times this event has occurred, and the information is helpful to those performing periodic inspections of the meter, as it may indicate that tampering has occurred. Otherwise execution proceeds normally as at box 96. On a hardware level, the flip-flop is preferably set when the door-open signal arrives, is reset by the processor, and the output of the flip-flop is made available as in input to the processor.

Those skilled in the art will appreciate that there are other ways the signal from switch 84 may be used to achieve similar results, without departing from the invention. For example, the signal may be presented as an interrupt to the processor, so that if the interrupt arrives during franking an exception handler is invoked.

FIG. 11 shows the cover 44 and related features in perspective view. Wall region 85 protects the switch 84 (not shown for clarity in FIG. 11) from tampering. A shroud 84E partially covers the rotor 50 even when the cover 44 is open. A lever 84A is linked to cover 44 by a pin-in-slot arrangement, so that cover 44 is free to rotate through at least 90 degrees, while lever 84A only moves a few degrees, into and out of the light path of LED-phototransistor switch 84. Springs 84B urge lever 84A in the direction that indicates that the door 44 is not fully closed. Only if door 44 is fully closed does the lever 84A move to the position that causes an output from switch 84 indicative of the door being closed. Door 44 rotates on axle 84C which is held in place by C clips 84C.

Figure 1:
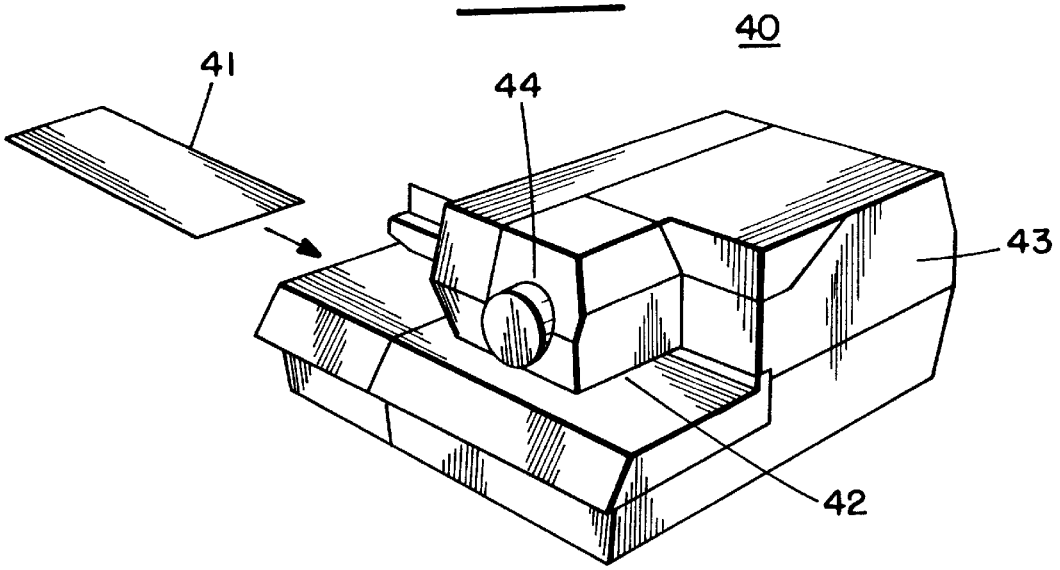
FIG. 1 shows the exterior of a postage meter in perspective view.

FIG. 13A shows a cover locking mechanism according to the invention. The cover 44 is hinged differently than as shown in FIG. 1, and is instead hinged transversely to the axis of rotor 50. The cover is hinged at pivot point 84D to the case 43, and is latched to case 43 by means of latch 104. Latch 104 has feature 106 which grips a mating feature 107 of the case 43. The cover 44 is optionally spring-loaded by spring omitted for clarity in FIG. 13A, biased to swing open, but the cover 44 is able to swing open only if the latch 104 is pressed (rightwards in FIG. 13A).

Axial cam 103, which is formed in the face of rotor 50, determines when latch 104 may be pressed. When the rotor 50 is in its home position, relieved area 101 is aligned with cam follower 105, and it is possible to press the latch 104, in which case the cover 44 springs open. On the other hand, when the rotor 50 has rotated away from its home position to an angle at which the value wheels might be reached via the cover 44, the raised area 102 of the cam surface 103 blocks cam follower 105 and it is not possible to press the latch 104.

A second aspect of the design prevents the cover 44 from being opened at the wrong time. Feature 120 on the inside of the cover engages a rotor flange portion 103B. It will thus be appreciated that there are actually two distinct mechanical constraints on the cover. The cam surface 103 controls movement of the cover latch area 104 towards the rotor 50, that is, rightwards in FIG. 13A. In contrast, the rotor flange 103B controls movement of the cover 44 upwards, that is, toward the top of FIG. 13A.

FIG. 13B shows the situation when the cover 44 is not closed all the way. Feature 106 is above and disengaged from feature 107. Lever 84A, urged clockwise by springs, causes the output of sensor 84 to change. Line 84F shows in phantom the position of the lever 84A when the cover 44 is fully closed.

Figure 14:
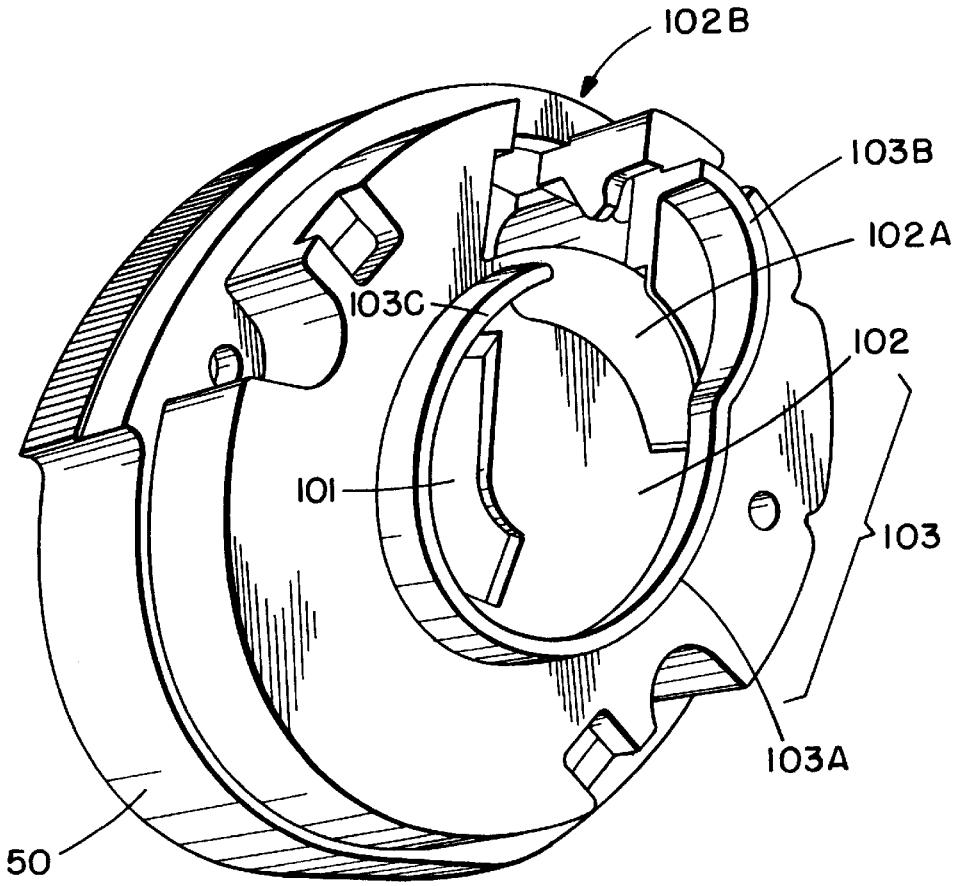
FIG. 14 shows in end view an axial rotor cam used with the cover of FIG. 13.

Axial cam 103 is shown in perspective view in FIG. 14. Relieved area 101 is shown, together with raised area 102 and releived area 102A. A relieved area 102B is provided so that when the cover 44 is swinging upwards it will not catch on the rotor 50. Rotor flange 103A, 103C holds the cover closed due to engagement with feature 120 (FIG. 13A) during much of the rotation of the rotor 50. During franking the rotor 50 rotates counterclockwise in FIG. 14. If the cover were not quite closed, and if the rotor begins to rotate, flange portion 103B will engage feature 120 and draw it downwards, in the direction of being fully closed.

As was mentioned earlier, the ability of the cover 44 to be unlatched and opened is limited not only by the vertical constraint of the rotor flange 103A, 103C, 103B, but also by the cam surace 103. Recall that the cover 44 has two features 105, 120 (FIG. 13A). For the feature 106 to be released from feature 107 (FIG. 13A) it would be necessary that the latch area 104 (FIG. 13A) be moved toward the rotor (rightwards in FIG. 13A). But this is possible only if feature 105 is more or less lined up with relieved area 101, and only if feature 120 is more or less lined up with relieved area 102A; this happens only if the rotor is in its home position (or if it is at about 180 degrees from the home position).

On a practical level the result is that the latch cannot be triggered by the user if the rotor 50 is at one of the the rotor angles at which the value wheels 30 would be accessible if the cover 44 were open. Stated differently, any tampering that is severe enough to get the cover opened when the rotor is not in the home position will probably damage the rotor flange 103A, 103B, 103C and the feature 120, which would be noted the next time the meter is inspected.

Figure 2:
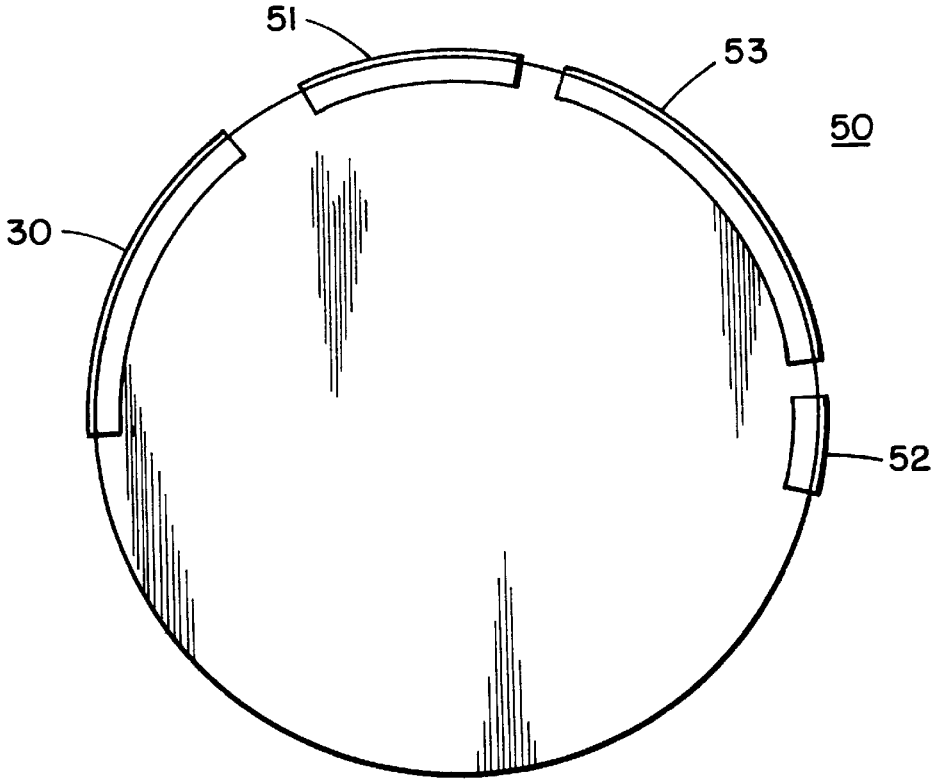
FIG. 2 shows in axial view a print rotor.
Figure 15:
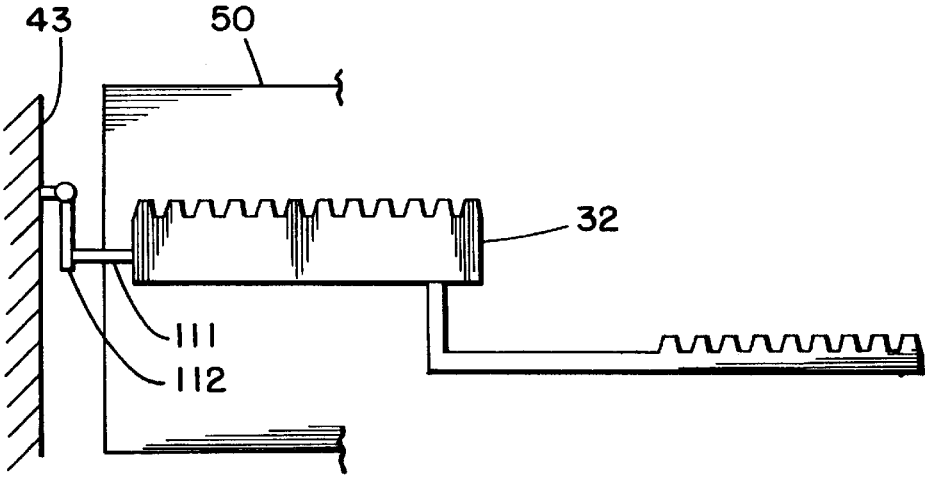
FIG. 15 shows in cross section a cover release latch actuated by a rotor wheel setting rack in its extreme axial position.

Another way of securing the cover 44 is shown in FIG. 15. Lock 112, preferably secured to the case 43 but optionally secured to the cover 44 (omitted for clarity in FIG. 15), secures the cover through a latch, omitted for clarity in FIG. 15. Feature 111 is provided on rack 32, so that if the rack 32 is moved to the extreme leftward extent of its travel, the lock 112 releases the cover 44. Cover 44 is preferably spring-loaded by a spring similar to spring 110 of FIG. 13. Rack 32 performs its movement in response, for example, to a user request provided to the processor at the keyboard, not shown in FIG. 15 for clarity. In a meter of the type requiring manual adjustment of the date wheels 51 (FIG. 2), the processor preferably opens the door even if there has been no user request, for example if the internal clock of the meter indicates that the calendar date has changed with no indication of the date wheels 51 having been adjusted. This is shown in the flowchart of FIG. 17. If the date has changed and there is no indication that the date wheels have been updated, then at box 135 control passes to box 136. The door is released and the user is prompted to adjust the date wheels, for example by a message on the display screen. As mentioned above in this embodiment the door is preferably spring-loaded, for example by a spring 110 such as that shown in FIG. 13, so that when the processor actuates the actuator the door springs open in a way that is unmistakable to the user.

Similarly, if the user requests franking of a mail piece, and if the processor determines that the calendar date has changed with no indication of the date wheels 51 having been adjusted accordingly, the processor preferably opens the door 44.

The processor is programmed, of course, so that it will move rack 32 to trigger the lock 112 only when the rotor 50 is in its home position. This is shown in FIG. 18, where a request is received at box 130. A check is made at 131 to determine whether the request should be honored. Preferably if the meter is in the middle of a franking (printing) operation the request is denied and an exception handler 132 is invoked. Otherwise the door is released at box 133.

The rack 32 that triggers the lock 112 is movable along its length to an extent sufficient to permit selection of all of the indicia of its respective value wheel 30. When the rack 32 is to trigger the lock 112, it is moved to a position beyond the extent necessary to permit selection of all of the indicia of the value wheel 30.

From the user's point of view, the result is that the actuator is within the secure housing 43, and the user is substantially unable to open the cover 44 except upon actuation by the processor of the actuator.

Those skilled in the art will appreciate that another way to trigger the lock 112 would be by a discrete actuator such as a solenoid. Other software-controlled actuation mechanisms may be devised that would accomplish the same result, without deviating from the invention.

It will also be appreciated that the aforementioned aspect of the invention is not only useful in cases where a user must change a date wheel, but is also useful in other contexts. For example, even if the date wheels are automatically set (for example as described in copending application Ser. No. 07/953,062 filed Sep. 29, 1992) it may be necessary for the user to manually correct a print wheel position. It may also be necessary for a user to insert or remove an advertising plate. In any of these situations it is nonetheless desirable that the cover 44 remain closed most of the time, and it enhances the security of the meter if the cover 44 only opens when actuated.

Figure 33:
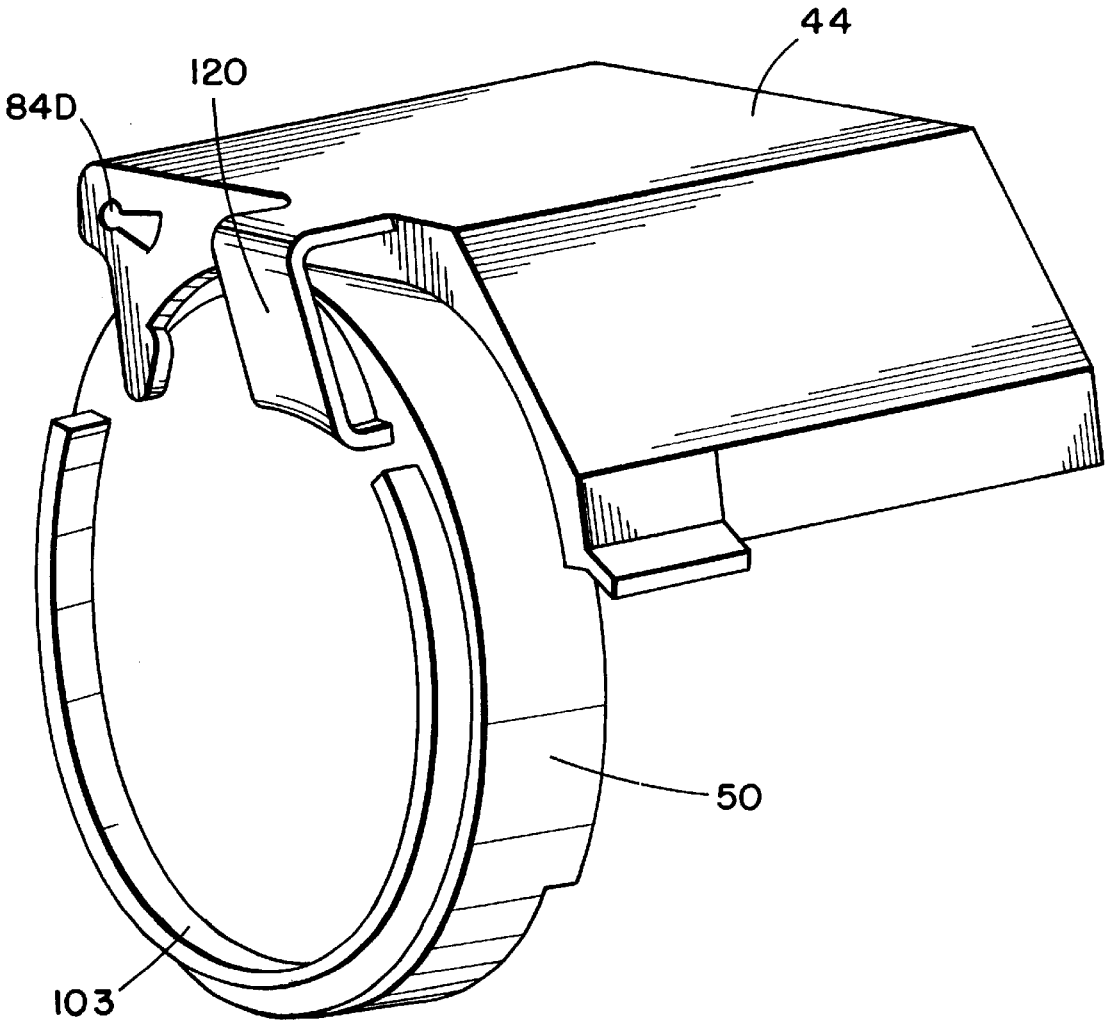
FIG. 33 shows an alternative embodiment of the improved meter rotor cover.

Turning now to FIG. 33, there is shown an alternative embodiment for the cover 44. In FIG. 13B the pivot 84D for the cover was perpendicular to the axis of rotation of the rotor. In FIG. 33, the pivot 84D is parallel with said axis. As a result, the preferred cover locking arrangement is different from that in FIG. 13B. A cam follower 120 engages with the inner surface of radial cam 103, when the rotor 50 is not in its home position. This prevents a user from opening the cover 44 when the rotor is not in its home position except with application of great force. The great force will damage the cam 103 or the cam follower 120 or both, and the damage will be noted at the next meter inspection. In this way unauthorized tampering with the rotor door will be detected.

Figure 16:
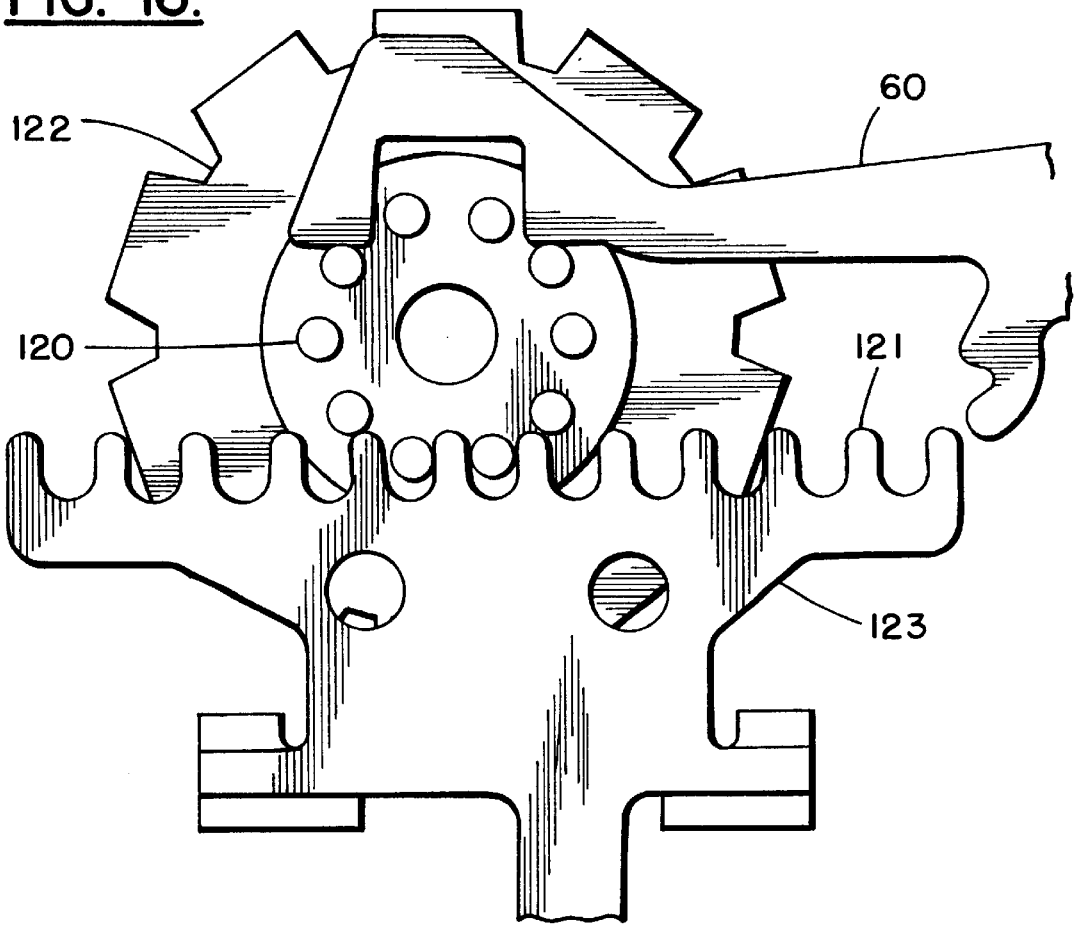
FIG. 16 shows a print wheel rack mechanism according to the invention, in which cogs are employed.

In FIG. 16 is shown an alternative embodiment for the value wheels and racks, corresponding to the view of FIG. 7. Value wheels 122 correspond in function to wheels 30 of FIG. 7, and racks 123 correspond in function to racks 32 of FIG. 7. Wheel 122 is formed with cogs 120, and rack 123 is formed with cog-teeth 121. The use of cogs 120 and cog-teeth 121 offers very little opportunity of jogging a value wheel 122, due to the geometry of the points of contact therebetween. An attempt to jog a value wheel would likely result in breakage of one or more cogs 120, which would disable the meter.

Figure 3:
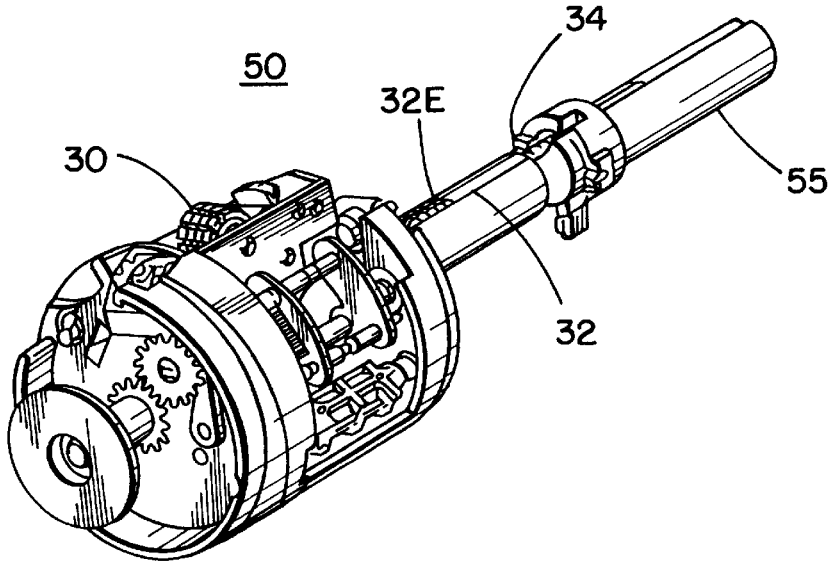
FIG. 3 shows in perspective view a print rotor and its associated axle.
Figure 32:
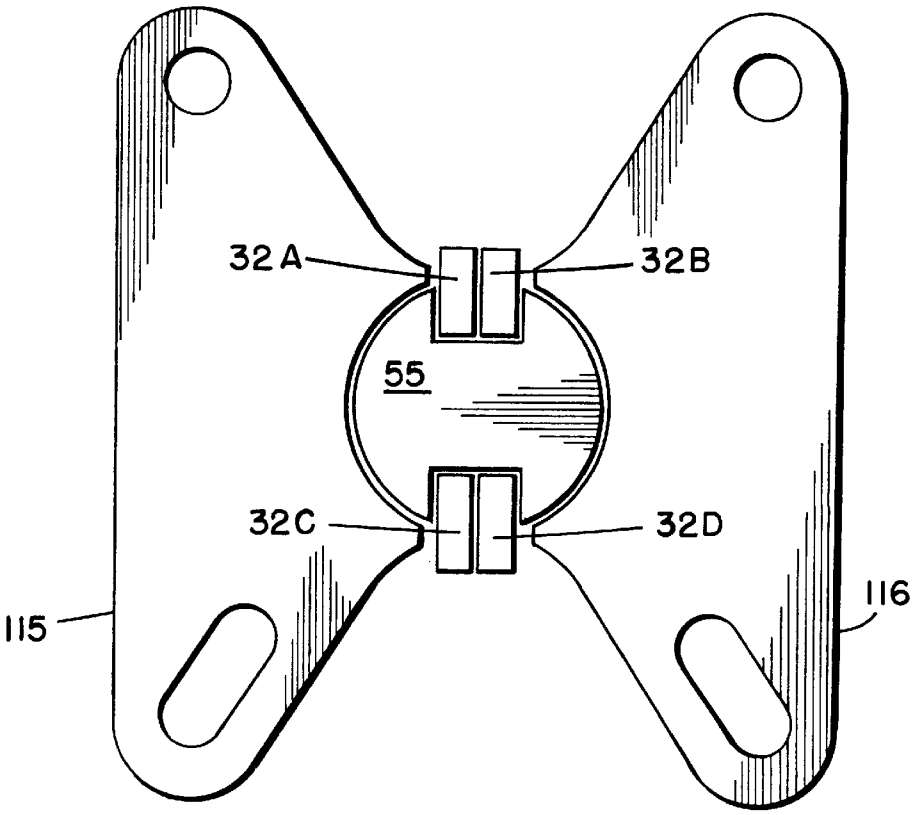
FIG. 32. PRIOR ART
FIG. 32 shows a prior art rack locking arrangement.

Returning to FIG. 3, it will be recalled that racks 32 move axially along axle or shaft 55 to effect controlled rotation of the value wheels 30. Two racks 32 are seen on the top of the shaft 55 and, not visible in FIG. 3, there are two racks 32 in the bottom of the shaft 55. The shaft is thus basically H-shaped, as described for example in U.S. Pat. No. 4,369,581, assigned to the same assignee as the assignee of the present invention, and incorporated herein by reference. Turning to FIG. 32, the H-shaped shaft 55 is shown in cross section, and the four racks 32A, 32B, 32C, and 32D may be seen.

The racks 32 each have a toothed area 32E. The teeth in this area are rectangular, and are defined by rectangular cuts between the teeth. There are at least as many cuts as there are print indicia on the value wheels. When the rotor rotates, it is assumed that the value wheels will already have been set to particular positions. The racks 32 should not move axially at all during the franking operation, and when the rotor returns to its home position the racks should be in precisely the same positions as they were in just prior to the rotation.

Prior art FIG. 32 shows a locking mechanism that is designed to hold the racks captive (that is, unable to move axially) during franking. Locking plates 115, 116 are fixed in the postage meter. When the rotor and shaft 55 are in their home position, the racks 32A, 32B, 32C, and 32D are free to move axially (into and out of the page in FIG. 32) and are not in contact with the locking plates 115, 116. When the rotor and shaft 55 move away from the home position, however, the racks come into contact with the locking plates.

The locking plates 115, 116 are within particular ones of the cuts in the racks. But those skilled in the art will appreciate that there is a point in the franking cycle when the rotor is about 180 degrees away from the home position. In and around that 180-degree position, at least two and sometimes four of the racks 32 are momentarily capable of axial movement, unconstrained by the locking plates 115, 116.

Figure 28:
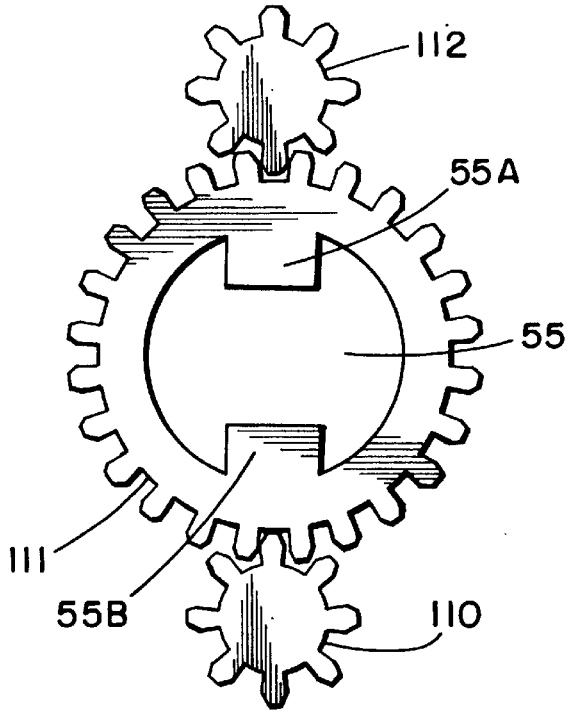
FIG. 28 shows locking gears.

In accordance with the invention, the potential vulnerability of the meter to tampering when the rotor is about 180 degrees from the home position is eliminated. In FIG. 28 may be seen a gear 111 fixed to the H-shaped shaft 55. Grooves 55A and 55B may be seen, in which the racks 32 (omitted for clarity in FIG. 28) move axially. Gear 111 has 24 teeth in a preferred embodiment, and smaller gears 112, 110 have eight teeth in a preferred embodiment. Thus one revolution of the rotor brings about three revolutions of the gears 112, 110.

Figure 29:
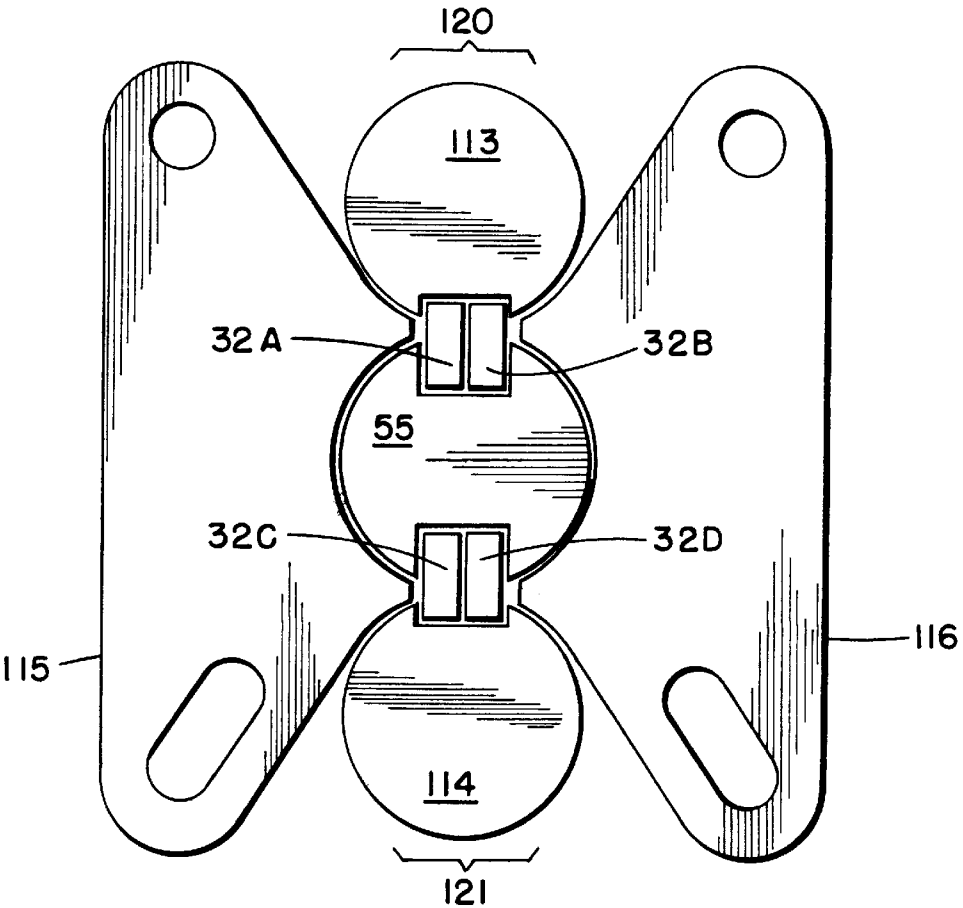
FIG. 29 shows locking disks associated with the locking gears of FIG. 28.

Turning now to FIG. 29, locking disks 113, 114 may be seen. Disks 113 and 114 are fixed to gears 112 and 110 respectively. Thus, disks 113 and 114 each rotate three times when the rotor rotates one time. A simple geometric analysis shows that when the shaft 55 is in the 180-degree position, then each of the disks 113 and 114 is likewise in a position 180 degrees away from its home position. At such a time the region 120 is engaged with slots or cuts in the racks 32A and 32B. Likewise the region 121 is engaged with slots or cuts in the racks 32C and 32D. Thus the racks are constrained from axial movement even when the rotor is in a position 180 degrees from the home position.

Figure 30:
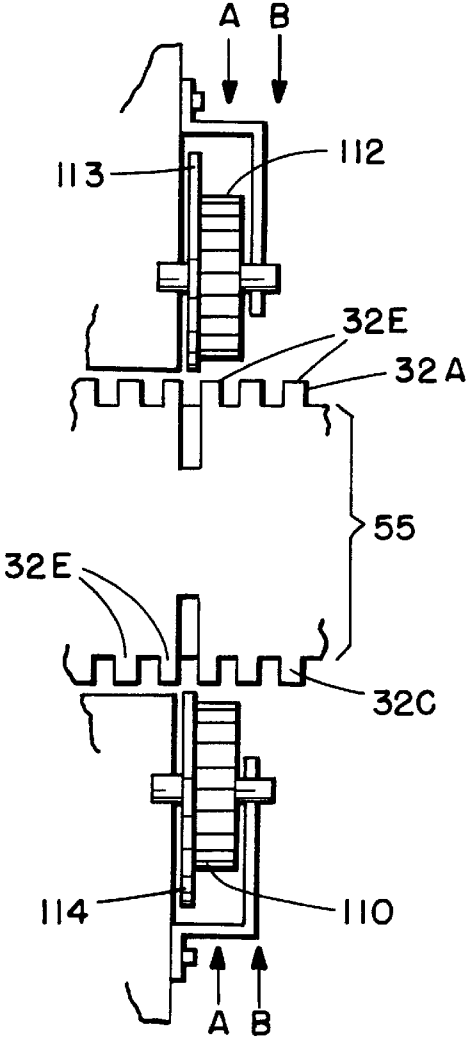
FIG. 30 shows a side view of the gears and disks of FIGS. 28 and 29 in the unlocked position.
Figure 31:
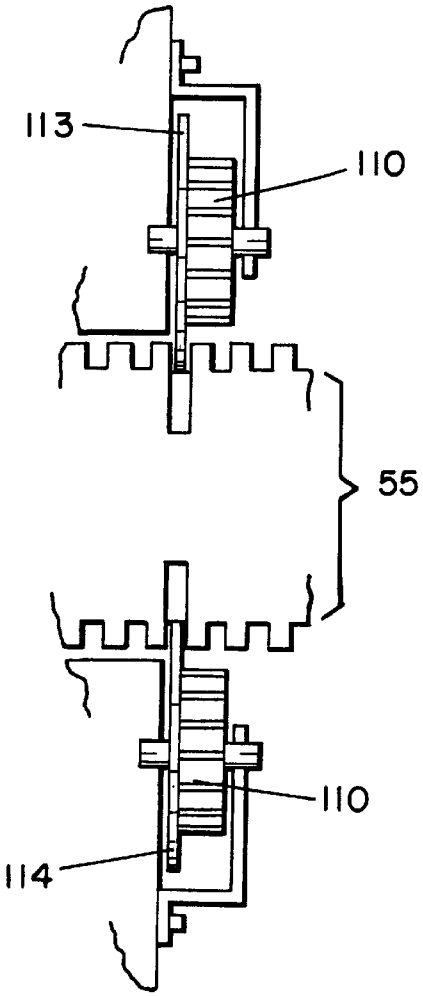
FIG. 31 shows the side view of FIG. 30 in the locked position.

FIG. 30 shows a cross section of the improved rack locking mechanism. FIG. 28 is taken along section B in FIG. 30. FIG. 29 is taken along section A in FIG. 30. Teeth 32E may be seen in rack 32A. The gear 112 and its disk 113 may be seen nearby to the rack 32A. Likewise the gear 110 and its disk 114 may be seen nearby to the rack 32C. FIG. 30 shows the state of affairs when the rotor and shaft 55 are in home position. In contrast, FIG. 31 shows the relationship when the rotor and shaft 55 are 180 degrees from the home position. Disks 113, 114 protrude into the rectangular cuts of the racks, blocking axial movement (to the left or right in FIG. 31).

Those skilled in the art will appreciate that the benefits of the arrangement of FIGS. 28 and 29 are available if gear 111 has a number of teeth constituting an odd multiple of the number of teeth of the gear 112 or the gear 110.

The arrangment of FIGS. 28 and 29 is, as described above, intended to minimize opportunities to fiddle with the positions of the racks 32 when the rotor is out of its home position. Turning back to FIG. 4, it will be recalled that each rack 32 is caused to be moved one way or another along the shaft 55 by corresponding pinion 37. In an electronic postage meter the pinions 37 are controlled by servomechanisms 36. In a purely mechanical postage meter the pinions 37 rotate through the action of setting levers, which are set by the user to select the amount of postage to be printed. Each of the pinions 37 is thus mechanically linked with a respective setting lever.

In addition to minimizing opportunities for fiddling with the positions of the racks, it will be appreciated that it is also desirable to minimize opportunities for fiddling with the positions of the pinions. For example, in a purely mechanical meter of the type having a meter body with a secure housing, and a separate non-secure base, it is normally impossible to slide the setting levers when the rotor is out of its home position. A locking device, sometimes called a cross, locks the setting levers whenever the rotor is out of its home position. But suppose that it were physically possible to tamper with the base in a way that makes it possible to (1) halt rotation of the rotor at a position away from its home position and (2) slide the setting levers, thus overcoming the cross locking device. In such a case, referring again to FIG. 4, it might be possible to slide a setting lever to a different position, then allow the rotor to return to home. The relationship between the setting lever position and the value wheel position, which is normally fixed, would be disrupted. The user might print a postage amount that was in excess of the amount being subtracted from the descending register.

What's more, if such tampering were possible, then a user could fiddle with the meter one one day, print lots of unauthorized postage, then fiddle with the meter again to restore the normal relationship between the racks and the pinions. As a result, the periodic inspection of the meter might not detect that the fiddling had taken place.

Figure 34:
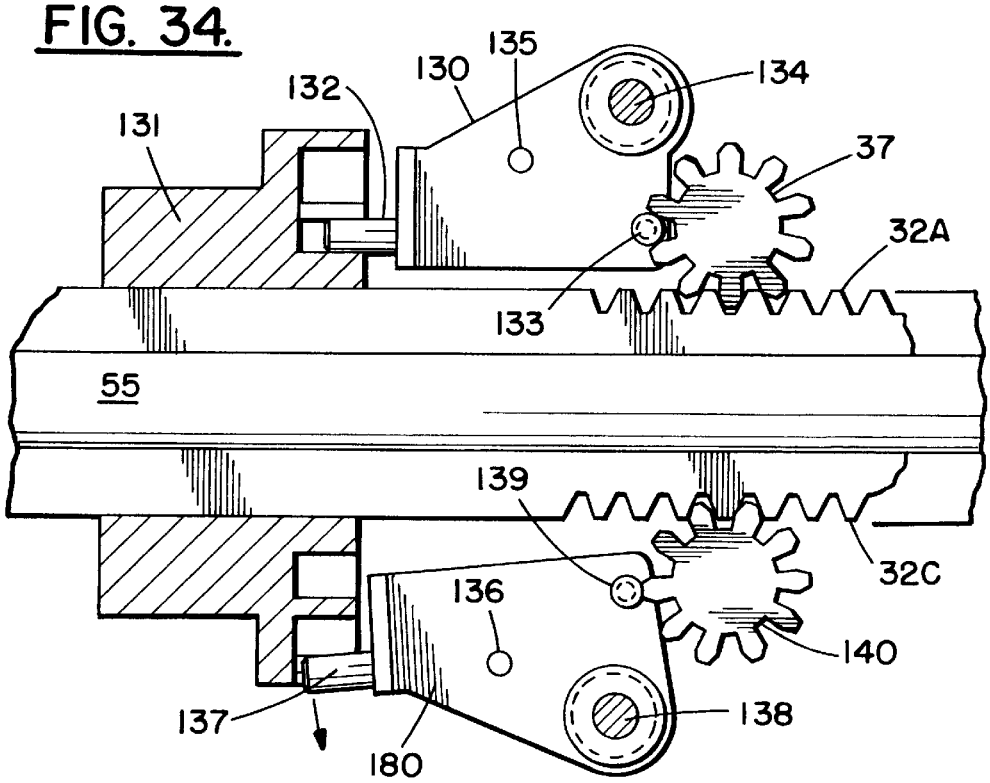
FIG. 34 is a cross-sectional view of a locking device for locking setting levers in a mechanical postage meter.

To protect against such fiddling with the setting lever pinions 37 (FIG. 4) a mechanism such as that shown in FIG. 34 may be used in accordance with the invention. In this cross section, shaft 55 may be seen, and two of the four racks 32A, 32C are visible. When the rotor is in its home position, the racks are engaged with the pinions. This means the pinions can only move if the corresponding racks move, and vice versa.

In accordance with the invention, spring-loaded detent members 130, 139 are provided. Preferably a pair 130, 180 of members is drawn together by a spring hooked to points 135, 136, so that the number of springs is half of the number of detent members. In FIG. 34, the lower detent member (180) is shown in the position to which it is deflected when the pinion 140 is rotated. If the pinion is rotated through, say three digit positions, then the detent member moves back and forth a corresponding number of times. Pins 133, 139 ride up and down the teeth of the pinions 37, 140 as they rotate.

Figure 4:
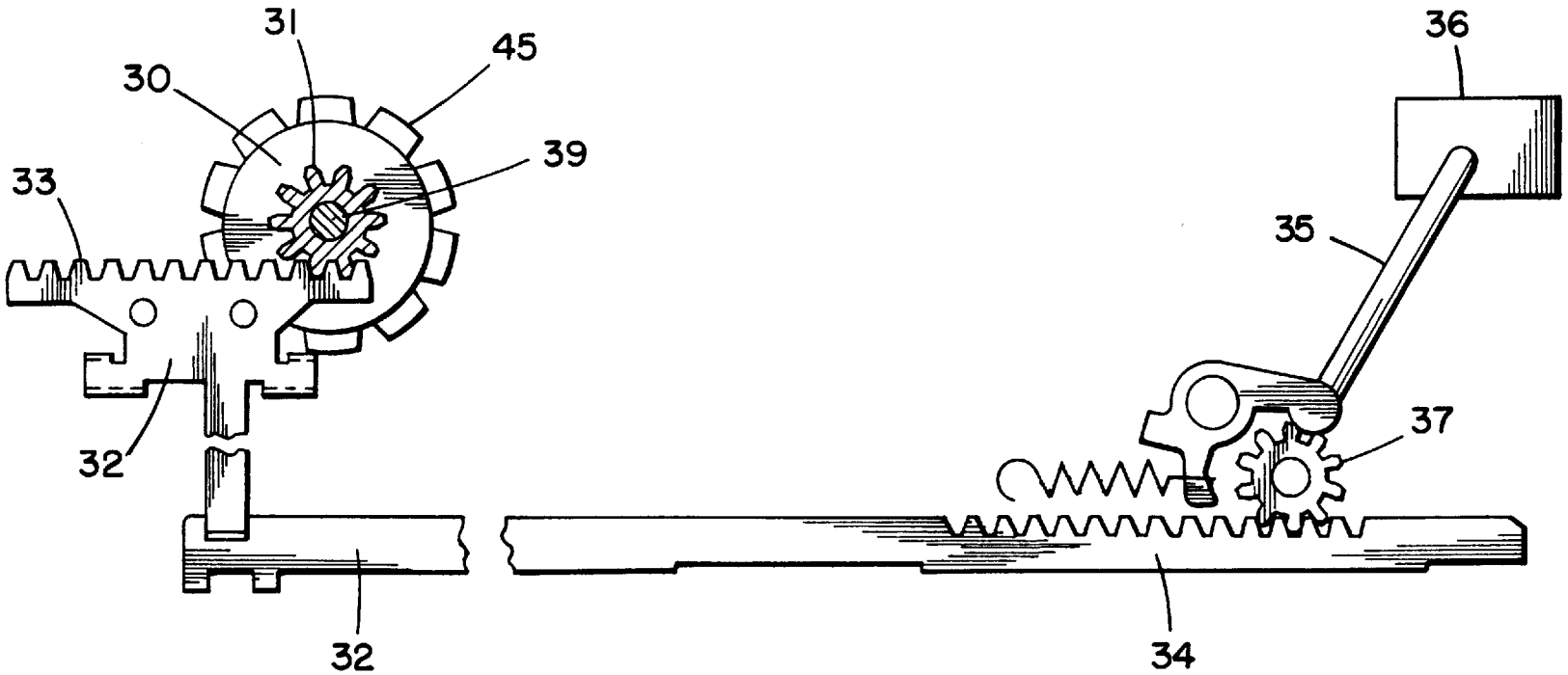
FIG. 4. PRIOR ART
FIG. 4 shows in simplified form the prior-art linkage connecting the print wheel with the setting mechanism.

If there were no cam followers 132, 137, then the function of the detent members 130, 180 would be similar to that of the detent shown in prior art FIG. 4. Cam followers 132, 137 engage with radial cam 131. Radial cam 131 is shaped so that when the rotor is in its home position, the detent members are free to move back and forth to accommodate rotation of the pinions. Radial cam 131 is also shaped so that when the rotor is not in its home position, the detent members are held captive by their respective cam followers, and thus the pinions are not permitted to rotate. In this way the meter protects against fiddling with pinion positions through sliding of the setting levers when the rotor is away from its home position.

Figure 38:
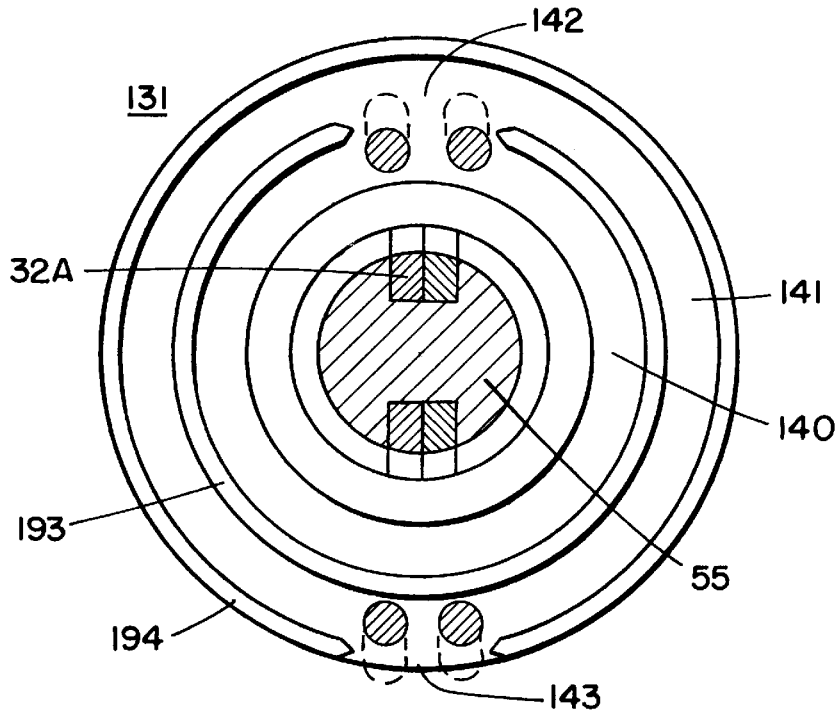
FIG. 38 is a plan view of the radial cam of the system of FIG. 34.

In the preferred embodiment of FIG. 34, it will be noted that the cam follower 132 is not in a mirror image with the cam follower 137. The cam followers are set at different radii from the shaft 55, to engage separate cam surfaces in the cam 131. FIG. 38 shows the cam 131 in axial plan view. Outer cam surface 194 may be seen, representing an incomplete circle. Its opening at 143 permits free movement of the detent member 180 when the rotor is in the home position. The cam surface 194 is functional on its inside circumference, so that when the rotor is not in its home position the detent member 180 is held in its locking position. Inner cam surface 193 may also be seen, also representing an incomplete circle. Its opening 142 permits free movement of the detent member 130 when the rotor is in the home position. The cam surface 193 is likewise functional on its inside circumference, so that when the rotor is not in its home position the detent member 130 is held in its locking position.

It will be noted that the concentric cam surfaces 194, 193 offer the important benefit that the pinions are no more at risk when the rotor is at 180 degrees from the home position than they are when the rotor is at other non-home positions. In FIG. 38 the shaft 55 and racks 32A etc. are visible.

Figure 35:
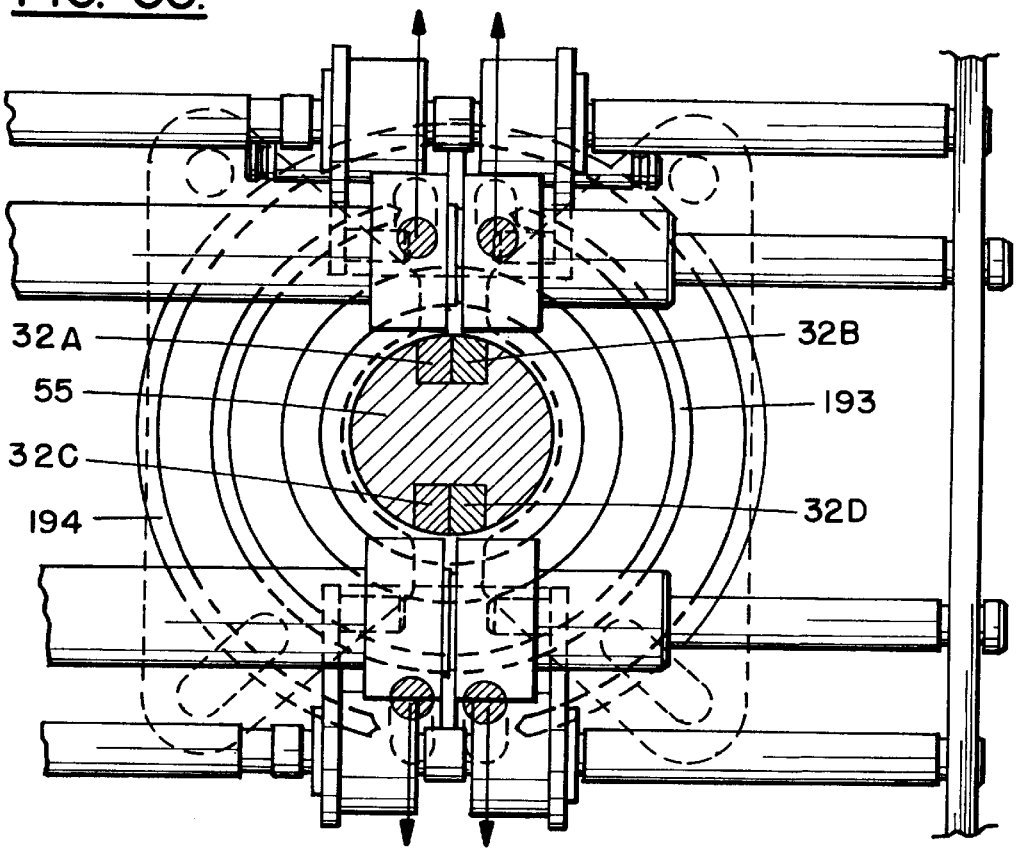
FIG. 35 is an axial view of the device of FIG. 34 in the unlocked position.

FIG. 35 shows the detent locking mechanism when the rotor is in its home position, in superimposed axial view. The shaft 55 is at center, with racks 32A etc. visible in grooves or channels therein. Juxtaposing FIGS. 35 and 38, it may be seen that the two top cam followers are free to move within the open area 142. Similarly, the two bottom cam followers are free to move within the open area 143.

Figure 36:
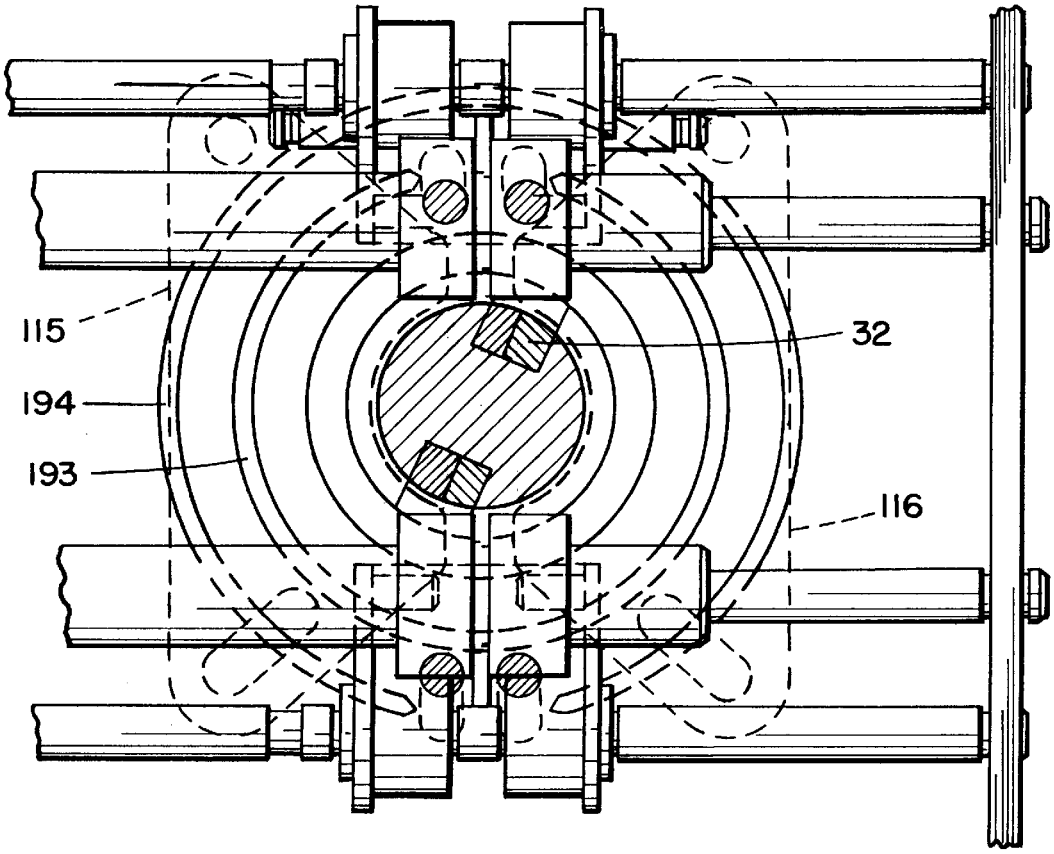
FIG. 36 is an axial view of the device of FIG. 34 in the locked position.

Turning briefly to FIG. 32, it will be recalled that locking plates 115, 116 serve to engage with the racks 32 when the rotor is not in its home position. Returning to FIG. 36, what is shown is the situation when the rotor has moved about nineteen degrees. The top left cam follower is now captive, held into the locked position by the inner cam surface 193. As a result the top left pinion is locked.

It might be thought that the top right pinion is free to rotate (and thus is at risk for fiddling) because the top right detent lock is not held by the cam surface 193. The pinion is not free to rotate, however, because one of the racks 32 is still engaged with the pinion, and is locked by the plate 116. After some additional rotation of the rotor the cam surface 193 reaches the point of engaging the cam followers of both of the upper detent locks. It will be noted once more that while the plates 115, 116 do not constrain the racks when the rotor is at 180 degrees, the cams 193, 194 do constrain the detent members at 180 degrees just as at other angles.

Figure 41:
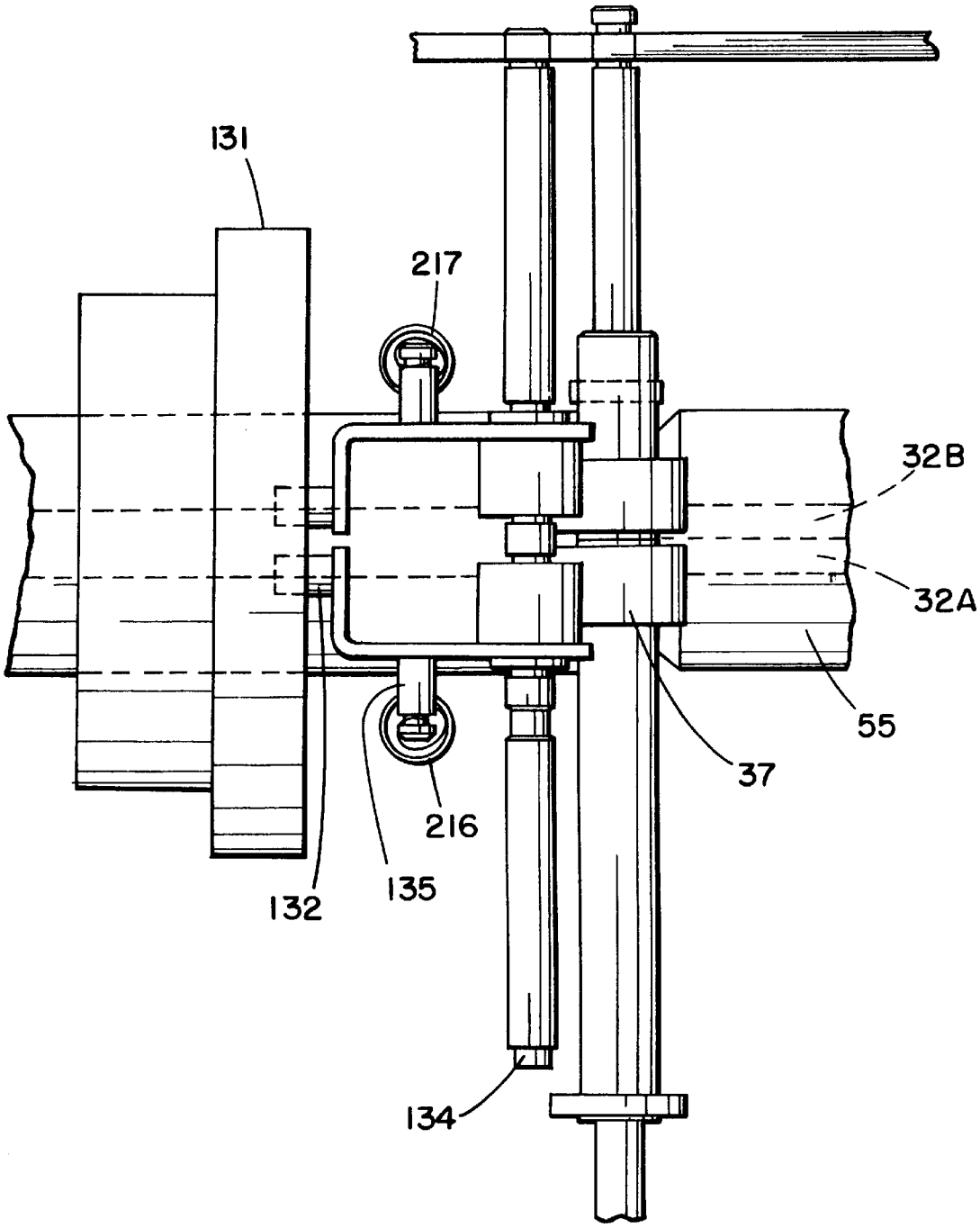
FIG. 41 is a top view of the system of FIG. 34.

FIG. 41 shows this arrangement in top view. Features 132 may be seen, which are posts on which the springs 216, 217 are hooked to urge the detent members toward the shaft 55.

Those skilled in the art will appreciate that this arrangement represents a way to protect against fiddling with setting levers entirely from within the secure housing of the meter. This differs from prior art approaches that only lock the setting levers by means of linkages through a non-secure base to which the meter is mounted.

Figure 39:
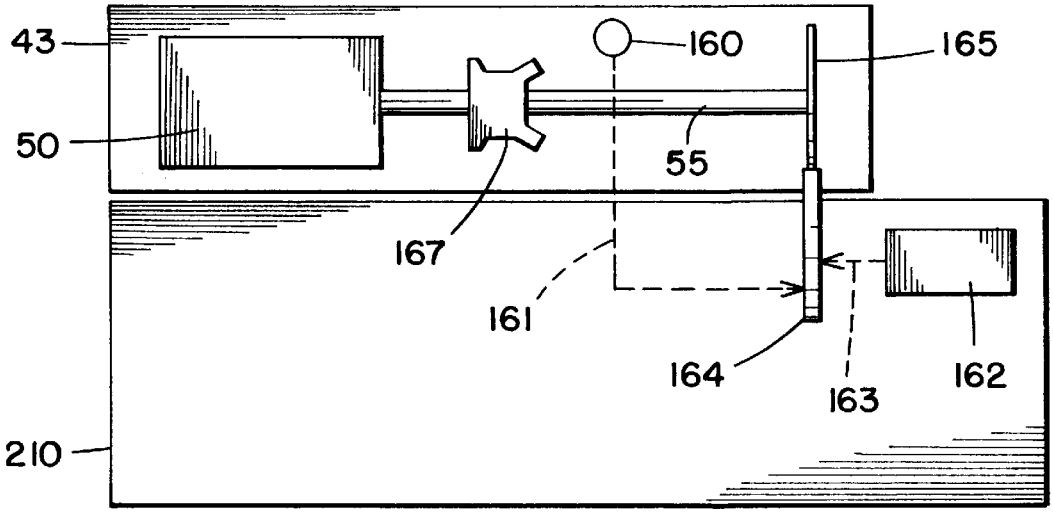
FIG. 39. PRIOR ART
FIG. 39 shows a prior art arrangement for locking the printing capability when the postage meter descending register reaches zero postage.

Turning now to FIG. 39, there is shown a prior art arrangement including a secure housing 43, a base housing 210, a rotor 50 on a shaft 55, a motor 162, and gears 164, 165 permitting the motor 162 to drive the rotor 50. A descending register, omitted for clarity in FIG. 39, has a shaft output 160, which output is communicated by a mechanical linkage 161 to the non-secure base with housing 210. Said linkage 161 prevents the base from providing motive power via gear 164 for franking by the meter portion in secure housing 43, in the event of the descending register dropping to a predetermined threshold value. The predetermined value is a function of the maximum possible printed amount. For example, in a meter which can print up to $9.99, the descending register will give its output at $10.00 or $9.99. As a convenient shorthand it is said that the descending register gives this output "at zero" but it will be understood that this means it gives its output at a time when there is the dange that the next franking will reach zero.

The meter has a crown gear 167 on the shaft 55, for use with mechanisms that are omitted for clarity in FIG. 39. If a user were able to tamper with the base, there is the possibility of disrupting link 161. The result might be the user being able to print postage value even though the descending register has dropped below zero.

Figure 37:
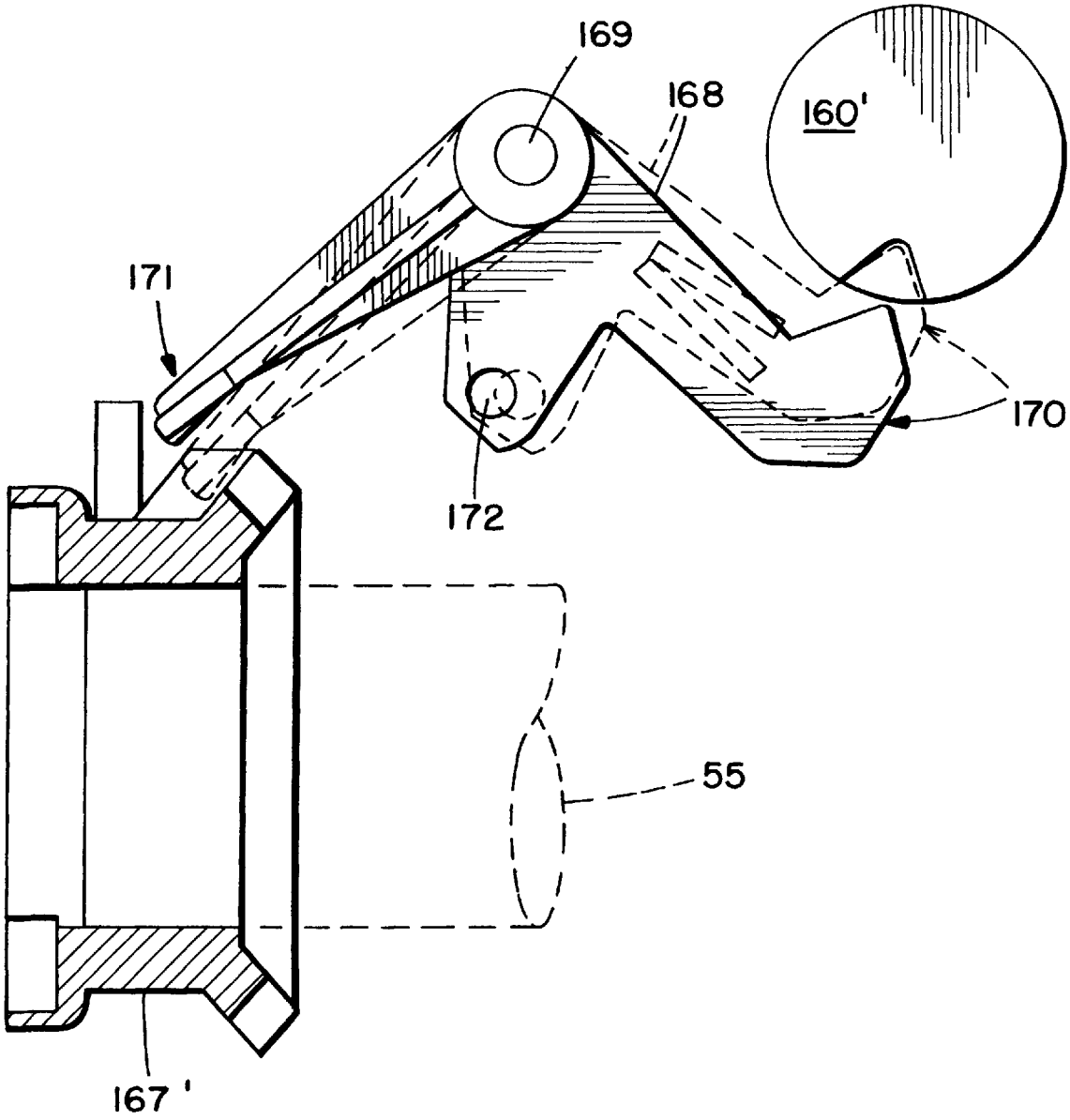
FIG. 37 is a cross section view of a locking mechanism for locking the print rotor shaft of a postage meter in the event that the descending register reaches zero.

In keeping with the invention, a cam surface is provided as shown in FIG. 37 on the descending register output 160'. This cam lines up with cam follower 170 when the descending register reaches zero. Locking member 168 is under spring tension at hole 172, so that if the cam and cam follower come into alignment the member 168 is urged counterclockwise in FIG. 37. Lever end 171 comes down into position by crown gear 167'. Advantageously crown gear 167' has an ear formed on its periphery, the ear positioned so that in the home position it is nearby to the lever end 171, and is on the side of the lever end 171 that would come into contact with the lever end 171 in the event that postage is printed. As a result, if the user tampers with the base and makes possible the printing of postage despite the descending register having reached zero, then the locking member 168 blocks rotation of the shaft 55 and thus the printing of postage. The meter jams which requires servicing by the manufacturer, at which time tampering will be detected.

Figure 40:
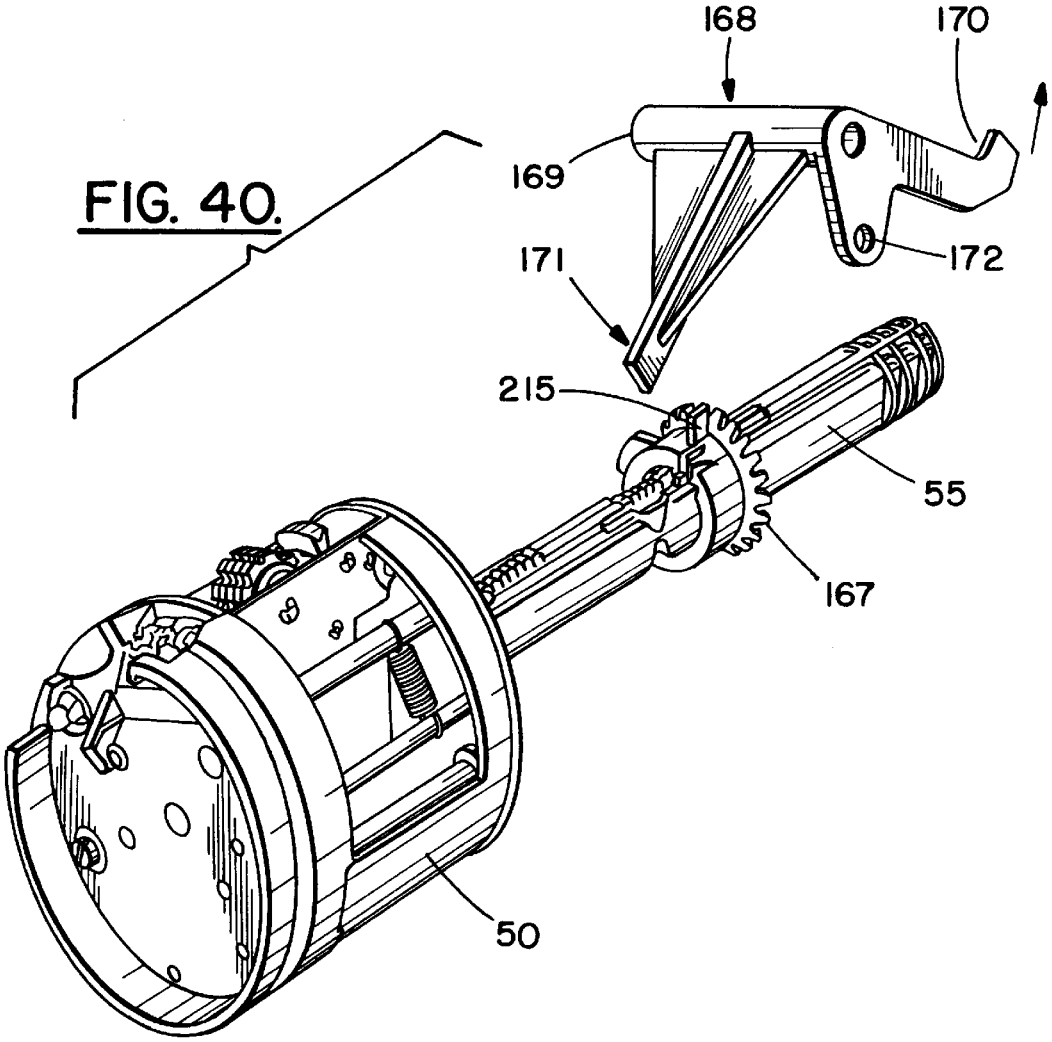
FIG. 40 is a perspective view of the system of FIG. 37.

FIG. 40 shows this arrangement in perspective. Crown gear 167 is visible on the shaft 55 of rotor 50. Lever end 171 drops down onto crown gear 167 and if rotor 50 rotates the ear 215 strikes the lever end 171, jamming the meter and preventing further printing of postage.

By means of the foregoing, the meter is more robust against attempts to jog value wheels. Those skilled in the art will appreciate that depending on the details of the design of the particular meter, one or more of the above-described protective measures may suffice to protect against attempted wheel jogging. It will also be appreciated that numerous obvious modifications and variations may be devised which differ in the precise implementation but which do not in any way depart from the invention, as set forth in the claims which follow.

What is claimed is:

1. A postage meter comprising a main body and a rotor rotatable relative to the main body for imprinting postage indicia on a mail piece through rotation thereof, the main body shaped to provide a secure housing for the postage meter, the meter further comprising a processor operative to control rotation of the rotor, the meter further comprising a cover movable between a first position in which a user has access to the rotor and a second position in which the user has no access to the rotor, the meter further comprising a switch disposed with respect to the cover to generate a signal indicative of the cover being in the first position, the signal made available as an input to the processor, the secure housing further characterized in that the switch is within the secure housing whereby the user is substantially unable to affect the generation of the signal indicative of the cover being in the first position.

2. The postage meter of claim 1 wherein the processor executes a stored program, the stored program characterized in that rotation of the rotor under processor control does not occur when the processor receives the signal indicative of the cover being in the first position.

3. The postage meter of claim 1 wherein the switch is a phototransistor, and wherein is further provided a light-emitting diode nearby thereto and a movable barrier selectively blocking light therebetween, the barrier operatively coupled to the cover.

4. The postage meter of claim 3 wherein the processor executes a stored program, the stored program characterized in that rotation of the rotor under processor control does not occur when the processor receives the signal indicative of the cover being in the first position.

5. The postage meter of claim 1 wherein the switch is a mechanical switch operatively coupled to the cover.

6. The postage meter of claim 5 wherein the processor executes a stored program, the stored program characterized in that rotation of the rotor under processor control does not occur when the processor receives the signal indicative of the cover being in the first position.

7. The postage meter of claim 1 wherein is further provided a flip-flop that is set when the signal is indicative of the cover being in the first position, the flip-flop resettable by the processor, the output of the flip-flop operatively coupled to the processor as an input thereto.

8. A method for use with a postage meter, the postage meter comprising a main body and a rotor rotatable relative to the main body for imprinting postage indicia on a mail piece through rotation thereof, the main body shaped to provide a secure housing for the postage meter, the meter further comprising a processor operative to control rotation of the rotor, the meter further comprising a cover movable between a first position in which a user has access to the rotor and a second position in which the user has no access to the rotor, the meter further comprising a switch disposed with respect to the cover to generate a signal indicative of the cover being in the first position, the signal made available as an input to the processor, the secure housing further characterized in that the switch is within the secure housing whereby the user is substantially unable to affect the generation of the signal indicative of the cover being in the first position, the method comprising the steps of:

receiving a request to print postage;

determining, by means of the signal, whether the cover is open; and denying the rotation of the rotor if the cover is open.

9. A method for use with a postage meter, the postage meter comprising a main body and a rotor rotatable relative to the main body for imprinting postage indicia on a mail piece through rotation thereof, the main body shaped to provide a secure housing for the postage meter, the meter further comprising a processor operative to control rotation of the rotor, the meter further comprising a memory and output means for providing information to a user, the meter further comprising a cover movable between a first position in which a user has access to the rotor and a second position in which the user has no access to the rotor, the meter further comprising a switch disposed with respect to the cover to generate a signal indicative of the cover being in the first position, the signal made available as an input to the processor, the secure housing further characterized in that the switch is within the secure housing whereby the user is substantially unable to affect the generation of the signal indicative of the cover being in the first position, the method comprising the steps of:

noting the event of the signal being generated during rotation of the rotor for imprinting postage indicia on the mail piece;

logging the event in the memory; and providing the logged information to a user.

* * * * *